US009411275B2

(12) United States Patent
Sugiyama et al.

(10) Patent No.: US 9,411,275 B2
(45) Date of Patent: Aug. 9, 2016

(54) IMAGE FORMING APPARATUS HAVING PARTITION CONFIGURED TO SEPARATE AIR FLOW AND SHEET FEEDING PATHS

(71) Applicant: CANON KABUSHIKI KAISHA, Tokyo (JP)

(72) Inventors: Shinichi Sugiyama, Kashiwa (JP); Koji Nojima, Abiko (JP); Takanori Sakurai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/138,888

(22) Filed: Dec. 23, 2013

(65) Prior Publication Data

US 2014/0178091 A1 Jun. 26, 2014

(30) Foreign Application Priority Data

Dec. 25, 2012 (JP) ..... 2012-281250

(51) Int. Cl.
*G03G 21/00* (2006.01)
*G03G 21/20* (2006.01)
*G03G 15/20* (2006.01)

(52) U.S. Cl.
CPC ..... *G03G 15/2028* (2013.01); *G03G 15/2017* (2013.01); *G03G 21/206* (2013.01)

(58) Field of Classification Search
CPC ..... G03G 21/206; G03G 2221/1645; G03G 15/2017; G03G 15/2028; G03G 15/2085; G03G 15/657
See application file for complete search history.

(56) References Cited

U.S. PATENT DOCUMENTS

| | | | | |
|---|---|---|---|---|
| 5,525,775 | A | 6/1996 | Setoriyama et al. | |
| 6,801,742 | B1 * | 10/2004 | Mochimaru | G03G 15/1605 399/124 |
| 7,526,242 | B2 * | 4/2009 | Takagaki | G03G 15/167 399/307 |
| 7,589,300 | B2 | 9/2009 | Nojima | |
| 8,139,995 | B1 | 3/2012 | Fujita et al. | |
| 2014/0086616 | A1 | 3/2014 | Nojima et al. | |
| 2014/0086617 | A1 | 3/2014 | Nojima | |

FOREIGN PATENT DOCUMENTS

| | | | |
|---|---|---|---|
| JP | 4-44075 | A | 2/1992 |
| JP | 2010-217580 | A | 9/2010 |
| JP | 2011-112708 | A | 6/2011 |

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes an image forming device configured to form, in a first position, a toner image on a sheet using toner containing a parting material; a fixing device configured to fix the toner image formed on the sheet by the image forming device in a second position, by heat and pressure; a fan configured to flow air along an air flow path between the image forming device and the fixing device; and a partition configured and positioned to substantially separate between the air flow path and a sheet feeding path from the first position to the second position.

10 Claims, 18 Drawing Sheets

(a)

(b)

IMAGE FORMING APPARATUS HAVING PARTITION CONFIGURED TO SEPARATE AIR FLOW AND SHEET FEEDING PATHS

FIELD OF THE INVENTION AND RELATED ART

The present invention relates to an image forming apparatus for forming a toner image on a sheet. The image forming apparatus may be a copying machine, a printer, a facsimile machine, or a complex machine having a plurality of functions of such machines, using an electrophotographic process.

In a conventional electrophotographic type image forming apparatus, a toner image is formed on a sheet using toner containing a parting material (wax), and the toner image is fixed by heating and pressing by a fixing device.

It is known that in the fixing process, the wax contained in the toner is gasified and is condensed immediately thereafter.

SUMMARY OF THE INVENTION

Much condensed wax (many fine particles (dust) having a particle size of about several nm-several hundreds nm) floats in the neighborhood of the sheet entrance of the fixing device. Most of the wax may scatter widely with air flow with the possible result of an adverse influence on the image. It is desirable to prevent wide scattering of the wax immediately after the condensation with the air flow.

On the other hand, with an electromagnetic induction type fixing device disclosed in Japanese Laid-open Patent Application 2010-217580, a heat generating element is provided adjacent a coil holder in order to prevent the wax from fixing and accumulating on a coil holder. More specifically, the coil holder is heated by the heat generating element to liquefy the wax to let the wax drop down from the coil holder.

In another example, with the fixing device disclosed in Japanese Laid-open Patent Application 2011-112708, the fine particles deposited on a fixing roller are removed by a cleaning web with the aid of a trapping material, contained in the cleaning web, for trapping the fine particle.

However, with the fixing devices disclosed in Japanese Laid-open Patent Application 2010-217580 and Japanese Laid-open Patent Application 2011-112708, it is not possible to suppress wide-range scattering of the dust existing in the neighborhood of the sheet entrance, inside of the machine.

Accordingly, it is an object of the present invention to provide an image forming apparatus in which particles having a predetermined particle size are produced from the parting material from scattering over a wide range.

According to an aspect of the present invention, there is provided an image forming apparatus comprising an image forming device configured to form, in a first position, a toner image on a sheet using toner containing a parting material; a fixing device configured to fix the toner image formed on the sheet by said image forming device in a second position, by heat and pressure; a fan configured to flow air along an air flow path between said image forming device and said fixing device; and a partition configured and positioned to substantially separate between the air flow path and a sheet feeding path from the first position to the second position.

Further features of the present invention will become apparent from the following description of exemplary embodiments with reference to the accompanying drawings.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

Figure 3:
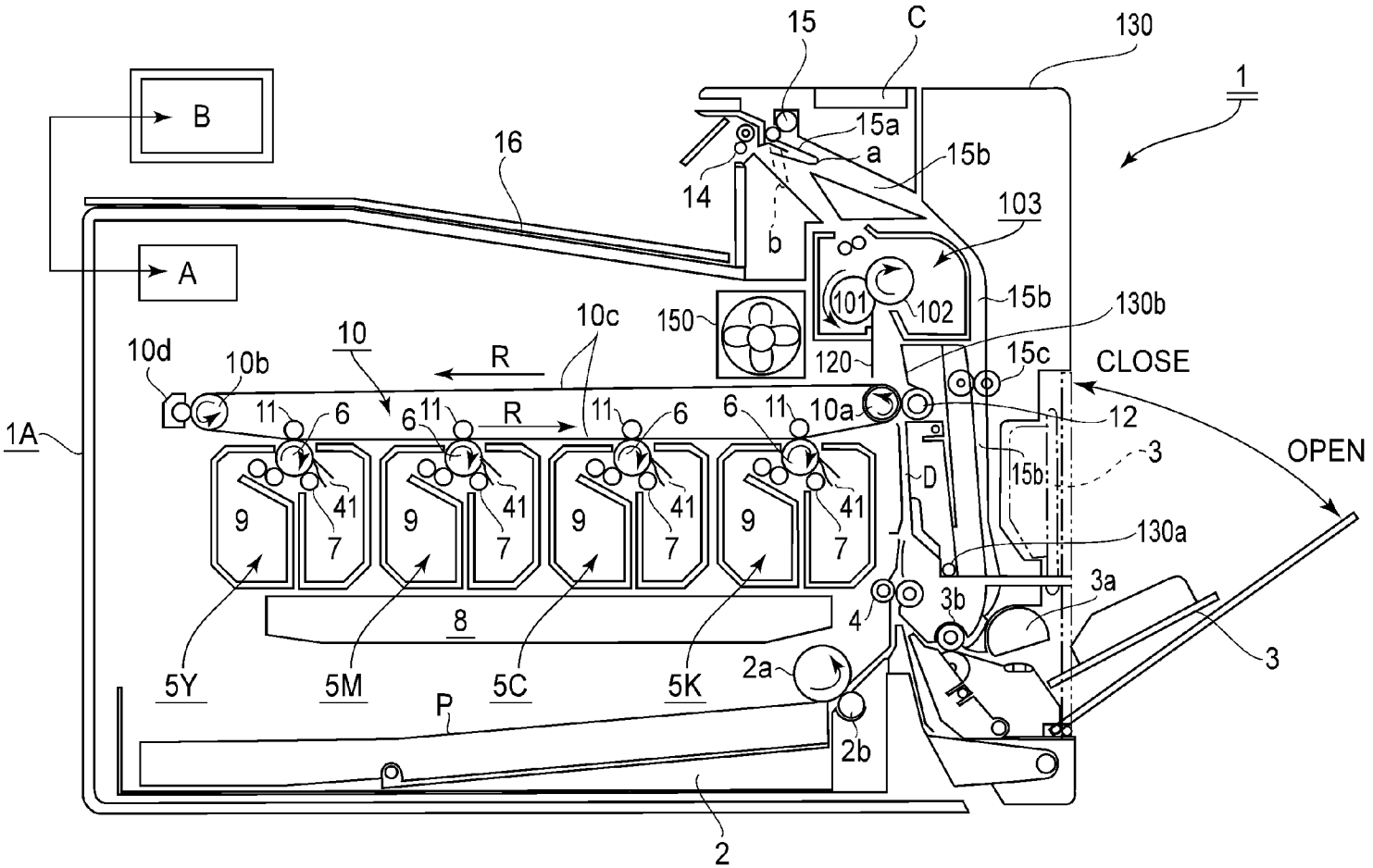
FIG. 3 is a schematic front sectional view of an image forming apparatus of Embodiment 1.

(1) General Arrangement of Image Forming Apparatus:

FIG. 3 is a schematic longitudinal front view of an image forming apparatus 1 according to this embodiment. The image forming apparatus 1 is a four full-color laser beam printer (color electrophotographic image forming apparatus) using an electrophotographic process. It forms a image on a recording material (sheet of paper, OHP sheet, label or the like) on the basis of an electrical image signal supplied to a control circuit portion (controlling means, CPU) from an external host apparatus B, such as a personal computer or an image reader.

control circuit portion A supplies and receives various electrical information between itself and the external host apparatus B and an operating portion C, and effects overall control of the image forming operation of the image forming apparatus 1 in accordance with a predetermined control program and/or a reference table. Here, in the image forming apparatus 1 of FIG. 3, the front side of the sheet of the drawing is a front side of the apparatus and the rear side of the sheet of the drawing is a rear side of the apparatus. The left and right directions are left and right as seen from the front side. The up and down directions are based on the direction of gravity.

The image forming apparatus 1 comprises, as image forming devices (image forming stations, first to fourth image forming stations 5 (5Y, 5M, 5C, 5K). The stations 5 are arranged in a substantially central portion in the main assembly 1A of the image forming apparatus 1, along a substantially horizontal direction from a left side to the right side.

The stations 5 comprise respective electrophotographic processing mechanisms that have similar structures. Each station 5 of this embodiment includes a rotatable drum-type electrophotographic photosensitive member (drum) 6 as an image bearing member on which an image is formed. It also comprises a charging roller (charging means) 7, a cleaning member (cleaning means) 41 and a developing unit (developing means) 9, at process means actable on the drum 6.

In a first station 5Y, a yellow (Y) developer (toner) is accommodated in a toner accommodation chamber of a developing unit 9. In the second station 5M, magenta (M) toner is accommodated in a toner accommodation chamber of a developing unit 9. In the third station 5C, cyan (C) toner is accommodated in a toner accommodation chamber of a developing unit 9. In the fourth station 5K, black (K) toner is accommodated in a toner accommodation chamber of a developing unit 9.

Below each station 5, there is provided a laser scanner unit 8 functioning as an image forming device (image forming station, exposure means) for the drum 6 of the image forming station 5. Above each station 5, there is provided a transfer unit (intermediary transfer belt unit) 10 functioning as an image forming device (image forming station).

The transfer unit 10 includes a driving roller 10*a* at the right side (FIG. 3), a tension roller 10*b* at the left side, and an intermediary transfer belt member (belt) 10*c* as the intermediary transfer member stretched around the rollers. Inside the belt 10*c*, first to fourth primary transfer rollers 11 opposing to the drums 6 of the stations 5 are provided in parallel with each other. Upper surface portions of the drums 6 of the stations 5 contact a lower surface of the lower traveling portion of the belt 10*c* at a position of each primary transfer roller 11. The contact portion therebetween establishes a primary transfer portion.

Outside a belt bending portion of the driving roller 10*a*, there is provided a secondary transfer roller 12 functioning as the image forming device (image forming station). The contact portion between the belt 10*c* and the secondary transfer roller 12 is a secondary transfer portion where the image is transferred onto the sheet P. Outside the belt bending portion of the tension roller 10*b*, a transfer belt cleaning device 10*d* is disposed.

Below the laser scanner unit 8, a sheet feeding cassette 2 is provided. A cassette 2 can be inserted into and drawn out of the main assembly 1A of the apparatus. In the right side in the main assembly 1A of the apparatus, there is provided an upward sheet feeding path (longitudinal path, substantially vertical recording material feeding path) D for feeding the sheet P fed from the cassette 2, upwardly.

Along the sheet feeding path D, there are provided, in the order from the lower side to the upper side, a roller pair of a feeding roller 2*a* and a retarding roller 2*b*, a pair of registration rollers, a secondary transfer roller 12, a fixing device 103, a flapper 15*a*, a pair of discharging rollers. An upper surface of the main assembly 1A of the apparatus constitutes a discharging tray (discharged sheet stacking portion) 16.

On a right-hand surface side of the main assembly 1A of the apparatus, a manual insertion feeding portion (multi-purpose tray) 3 is provided. The manual insertion feeding portion 3 can be folded to the main assembly 1A of the apparatus as indicated by the chain lines (closed state) when not used. In use, it is opened as indicated by the indicated solid lines.

The operations for forming a full-color image will be described. The control circuit portion A causes the execution of the image forming operation of the image forming apparatus 1 in response to a print start signal. More particularly, the drums 6 of the stations 5 are rotated at predetermined speeds in the clockwise direction indicated by the arrow, in timed relation with the image forming operation. The belt 10*c* is also rotated in the counterclockwise direction of an arrow R (codirectionally with the peripheral movement of the drum) at a speed corresponding to the speed of the drum 6. Also, the laser scanner unit 8 is driven.

In synchronism with the driving, the charging roller 7 supplied with a predetermined charging bias voltage in each station 5 electrically charges the surface of the drum 6 uniformly to a predetermined polarity and potential. The laser scanner unit 8 scans in the main scanning direction the surface of the drum 6 with the laser beam modulated in accordance with the image information signal for the corresponding color (Y, M, C, K). By this, an electrostatic latent image is formed on the surface of the drum 6 in accordance with the image information signal of the corresponding color. The electrostatic latent image thus formed is developed into a toner image (developer image) by a developing roller (developing member) of the developing unit 9. The developing roller is supplied with a predetermined developing bias voltage.

By the above-described electrophotographic image forming process operation, a Y chromatic toner image corresponding to the Y color component of the full-color image is formed on the drum 6 of the first station 5Y, and is primary-transferred onto the belt 10*c*. On the drum 6 of the second station 5M, a M chromatic toner image corresponding to the M color component of the full-color image is formed, and it is primary-transferred superimposedly onto the Y color toner image already transferred on the belt 10*c*.

On the drum 6 of the third station 5C, a C chromatic toner image corresponding to the C color component of the full-color image is formed, and it is transferred superimposedly onto the Y color+M color toner images already transferred on the belt 10*c*. On the drum 6 of the fourth station 5K, a K chromatic toner image corresponding to the K color component of the full-color image is formed, and it is transferred superimposedly onto the Y color+M color+C color toner image already transferred on the belt 10*c*.

To each of the first to fourth primary transfer rollers 11, a primary transfer bias of a predetermined potential and the polarity opposite to the charge polarity of the toner is applied at predetermined control timing. In this manner, Y color+M color+C color+K color full-color unfixed toner image is synthetically formed on the moving belt 10*c*. The unfixed toner image is fed to the secondary transfer portion by the continuing rotation of the belt 10*c*. In each station 5, the surface of the drum 6 after the primary-image transfer onto the belt 10*c* is cleaned by a cleaning member (cleaning blade) 41 so that the primary-untransferred toner is removed, thus preparing for the next image forming step.

On the other hand, one sheet P in the cassette 2 is picked up and is fed to the registration roller pair 4 by the feeding roller 2*a* and the retarding roller 2*b* at predetermined control timing. In the case of the manual insertion feeding mode, the sheet P is picked up by the feeding roller 3*a* from the manual insertion tray 3 and is fed to the registration roller pair 4 by the feeding roller pair 3*b*.

The sheet P is fed to the secondary transfer portion with predetermined control timing by the registration roller pair 4. In the secondary transfer roller 12, a secondary transfer bias voltage of a predetermined potential of the polarity opposite to the charge polarity of the toner is applied at the predetermined control timing. By this, the four color superimposed toner image is secondary-transferred all together from the belt 10*c* onto the surface of the sheet P, while the sheet P is being nipped and fed in the secondary transfer portion. In this embodiment, the station 5, the transfer unit 10, and the secondary transfer roller 12 constitute the image forming station for forming the toner image on the sheet P by the toner containing a parting material.

The sheet P leaving the secondary transfer portion is separated from the belt 10*c* and is fed to the fixing device 103 functioning as a fixing portion, where the toner image is heated and fixed into a fixed image on the sheet P. In this embodiment, the sheet P is fed upwardly in the feeding path leading to the fixing device 103 from the secondary transfer portion, up to the fixing device 103.

The sheet P is passed through the fixing device 103 upwardly and is fed under the flapper 15*a* held at a first attitude a indicated by solid lines and is discharged onto the discharging tray 16 by the discharging rollers 14. The secondary-untransferred toner remaining on the surface of the belt 10*c* after the secondary-transfer onto the sheet P is removed from the surface of the belt by the transfer belt cleaning device 10*d*, and the cleaned belt 10*c* is used repeatedly for the image forming operation.

In the both-side-printing mode, the sheet P having the fixed image on one side is not discharged onto the sheet discharge tray 16 after leaving the fixing device 103, but is refed to a duplex print feeding portion (re-circulation feeding path) 15*b* so that it is subjected to the printing operation on the second side thereof. More particularly, in this case, the P sheet leaving the fixing device 103 passes an upper side of the flapper 15*a* switched to a second attitude b indicated by broken lines, and is fed toward the sheet discharge tray 16 by the reverse feeding portion (switch-back roller pair) 15.

When a downstream end portion of the sheet P with respect to the feeding direction reaches the flapper 15*a*, the flapper 15*a* is returned to the first attitude a, and the reverse feeding portion 15 is reversely driven. By this, the sheet P is fed reversely (downwardly) in the duplex print feeding portion 15*b* and is refed to the registration roller pair 4 through the feeding roller (pair 15*c*, 3*b*). Thereafter, similarly to the case of the one-sided image forming mode, the sheet P is fed through the secondary transfer portion, the fixing device 103 and the discharging roller pair 14 and is discharged onto the sheet discharge tray 16, as a duplex print.

Above the manual insertion feeding portion 3, a right-hand door 130 is provided to permit access to the sheet feeding path (longitudinal path) D and to the fixing device 103 in the jam clearance and maintenance operations. The right-hand door 130 with the manual insertion feeding portion 3 can be opened and closed relative to the main assembly 1A of the apparatus about a rotational shaft 130*a* of the door.

Figure 4:
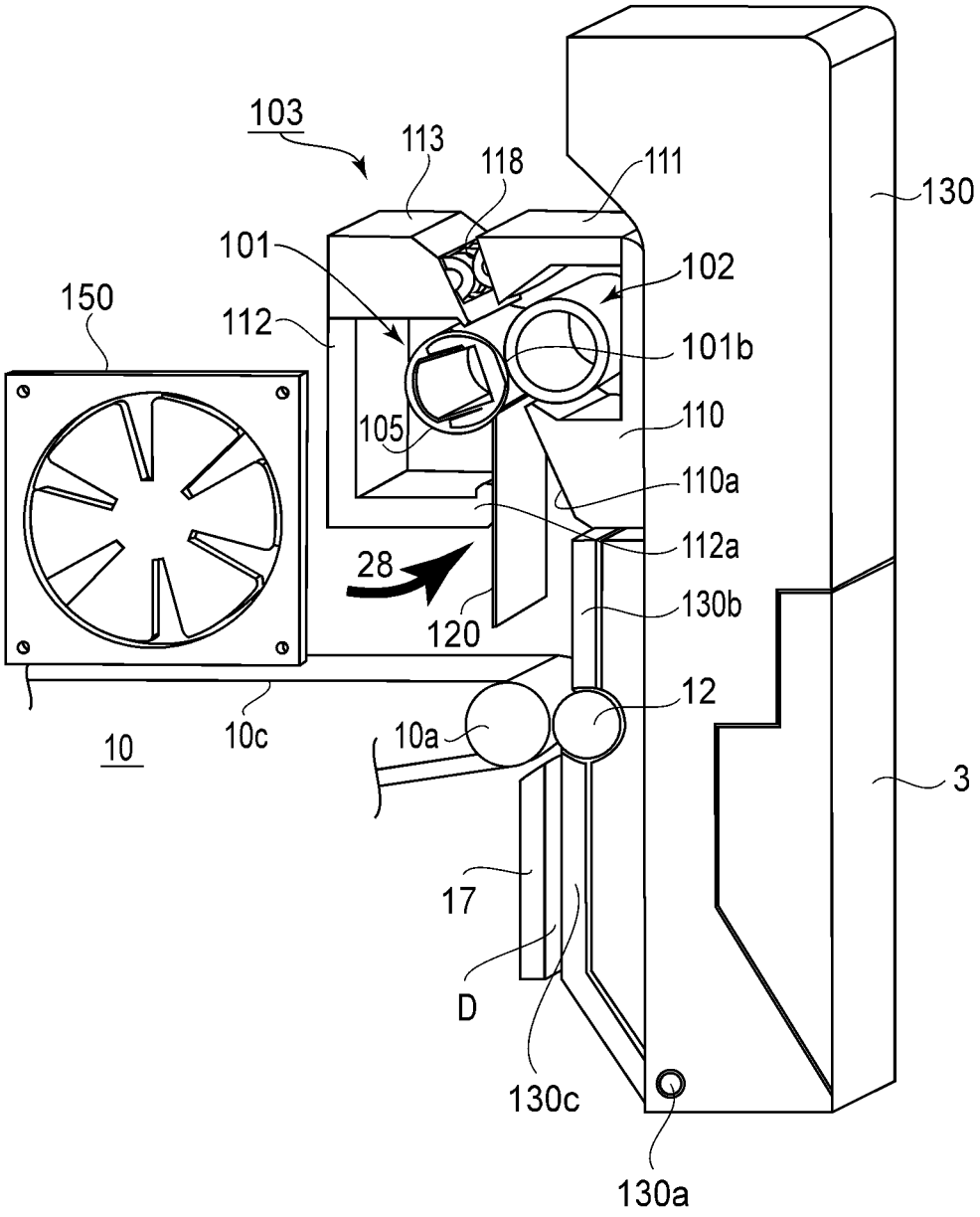
FIG. 4 is a schematic view illustrating a state in which a right-hand door is closed.
Figure 5:
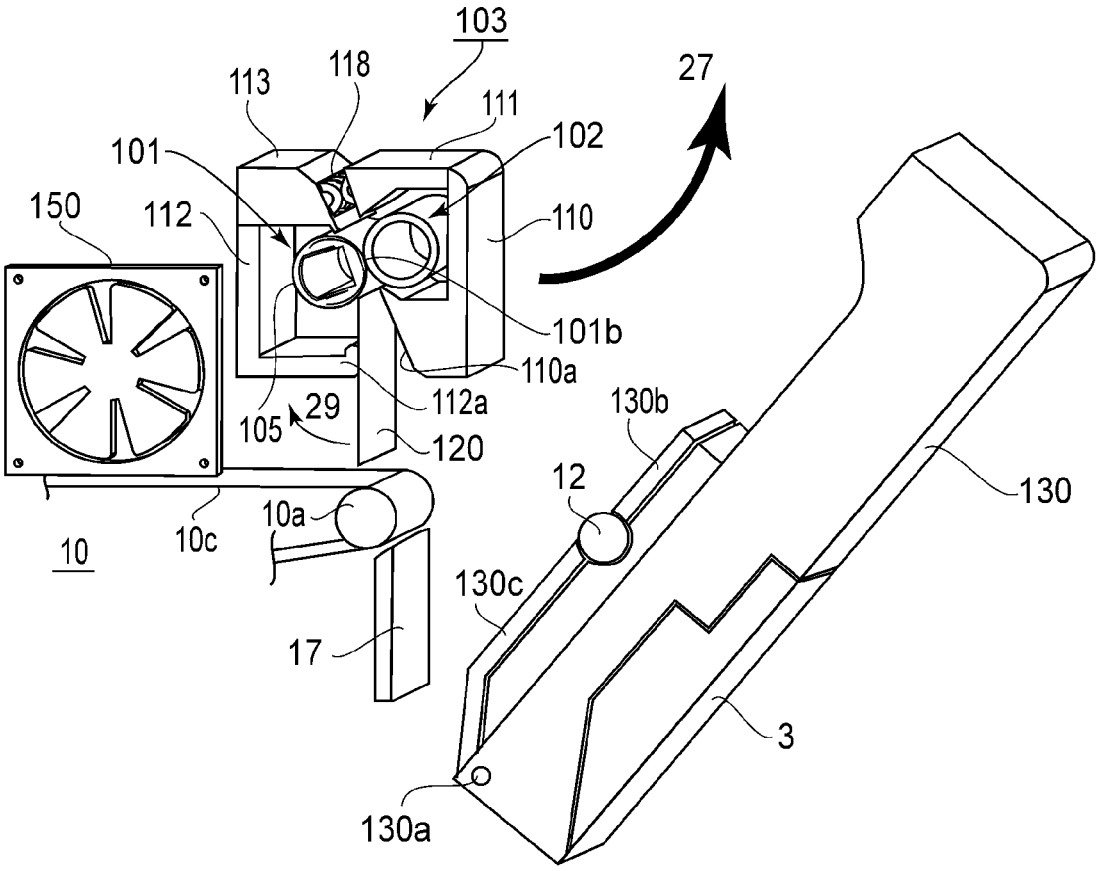
FIG. 5 is a schematic view illustrating a state in which the right-hand door is opened.

FIGS. 3 and 4 are schematic views illustrating the state in which the right-hand door 130 is closed. The image forming apparatus 1 is operable in the state that the right-hand door 130 is closed. In the jam clearance and/or maintenance operations, the right-hand door 130 is opened by rotating about the shaft 130*a* in the clockwise direction in FIG. 3. FIG. 5 is an illustration of the state in which the right-hand door 130 is opened. When the right-hand door 130 is opened, the portion of the sheet feeding path (longitudinal path) D from the registration roller pair 4 to the fixing device 103, the fixing device 103 and the duplex print feeding portion 15*b* are exposed. By this, the jam clearance and the maintenance operation can be carried out.

The secondary transfer roller 12 and the feeding guides 130*b*, 130*c* above and below it are disposed adjacent to the right-hand door 130. When the right-hand door 130 is closed, the secondary transfer roller 12 is contacted to the outside of the belt bending portion of the driving roller 10*a* of the transfer unit 10 to establish the secondary transfer portion. The feeding guide 130*b* guiding the sheet is disposed opposed to a sheet-like member (flexible sheet the functioning as a partition, which will be described hereinafter. The feeding guides 130*b*, 130*c* and the feeding guide 17 constitute the substantially upward sheet feeding path (longitudinal path) D.

When the right-hand door 130 is closed, the feeding guide 130*b* functions to guide, to the fixing device 103, the side of the sheet P not having the transferred unfixed image and having passed through the secondary transfer portion. In other words, the feeding guide 130*b* is a guide between the transfer unit 10 and the fixing device 103. It introduces the sheet P from the transfer unit 10 (secondary transfer portion) to the fixing device 103 while guiding the side opposite the toner image carrying side.

In order to suppress a temperature rise of the image forming station (intermediary transfer member) by the heat resulting from operation of the fixing device 103 and operations of the electrical parts such as a motor, an air flow path is formed therebetween. More specifically, a fan 150 is disposed as a cooling and/or ventilation means. The fan 150 is provided in a front side of the main assembly 1A of the apparatus. By this, the temperature of the image forming station can be suppressed below a predetermined temperature.

The fan 150 sucks the ambient air which is lower in temperature than the temperature inside of the apparatus and blows it into between the image forming station and the fixing device 103 through the front side of the main assembly 1A of the apparatus. The air is discharged through a louver (unshown) to the outside of the main assembly 1A of the apparatus. In this embodiment, the fan 150 is an air flow forming means for providing the air flow 28 (FIG. 4) for ventilation of the opening space adjacent the feeding guide 130*b* of the apparatus.

Figure 1A:
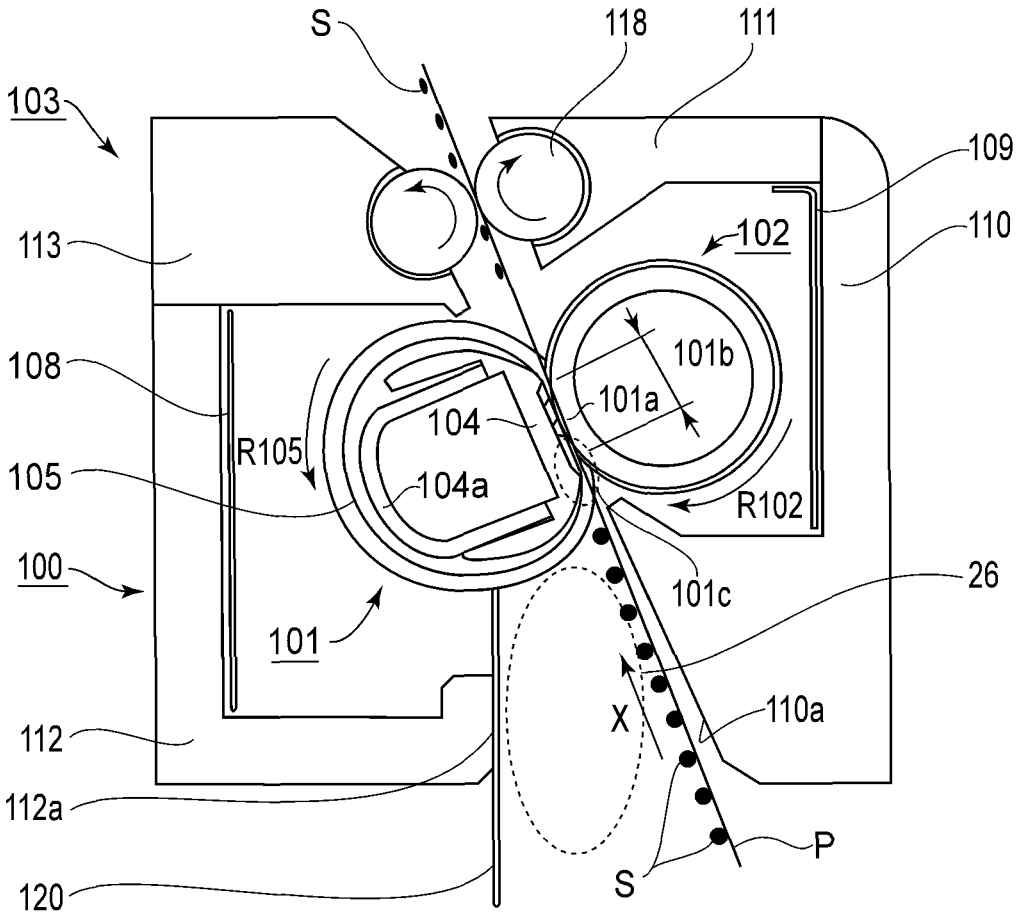
FIG. 1A is a schematic cross sectional view of a fixing device according to Embodiment 1 of the present invention.
Figure 1B:
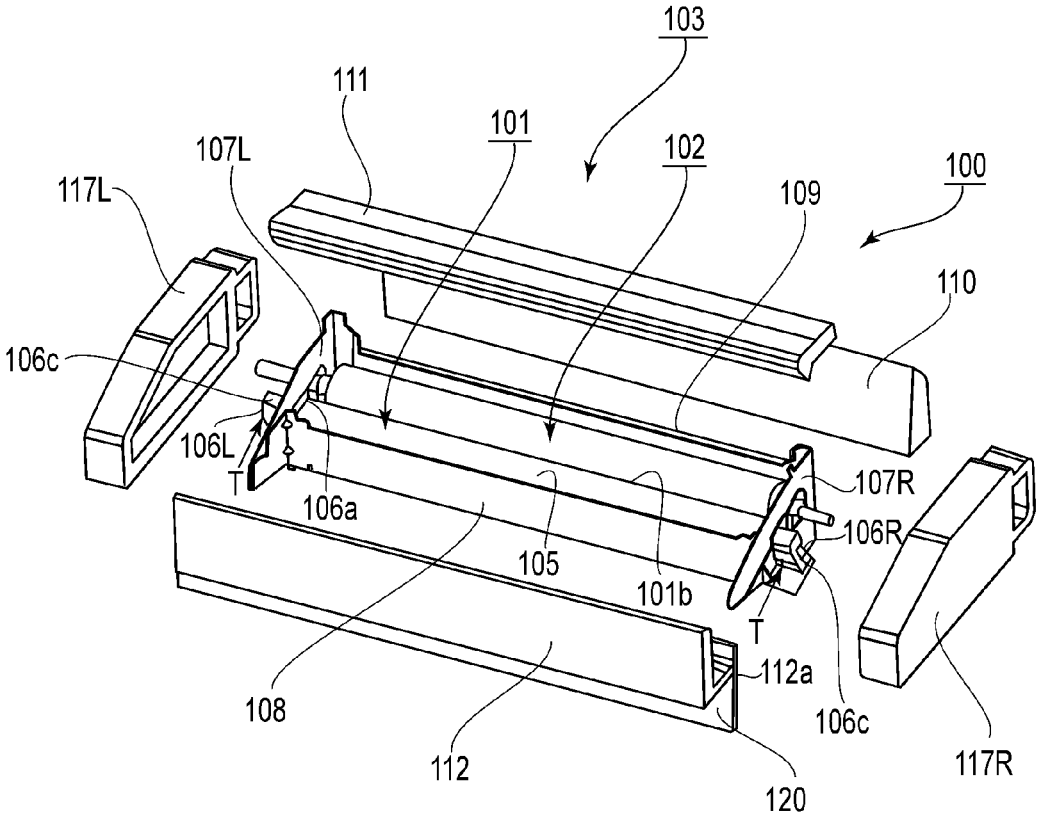
FIG. 1B is an exploded perspective view of the fixing device.

(2) Fixing Device 103:

FIG. 1A is a schematic cross sectional view of the fixing device 103 in this embodiment, and FIG. 1B is an exploded perspective view of the fixing device 103. In this embodiment, the fixing device 103 is an image heating apparatus of a belt (film) heating type and a pressing member driving type, using a planar (narrow plate-like) heater 101*a* such as a ceramic heater as a heating source. Such a type of heating apparatus is known by Japanese Laid-open Patent Application Hei 4-44075, for example.

The fixing device 103 is elongated in a directing direction perpendicular to the feeding direction (sheet feeding direction) X of the sheet in a sheet feeding path plane. The fixing device 103 generally comprises a heating unit 101, a pressing roller 102 as a back-up member (pressing member), and a casing (fixing casing) 100 accommodating them. The casing encloses the heating unit 101 and the pressing roller 102 so as to permit passage of the sheet therethrough.

Figure 2:
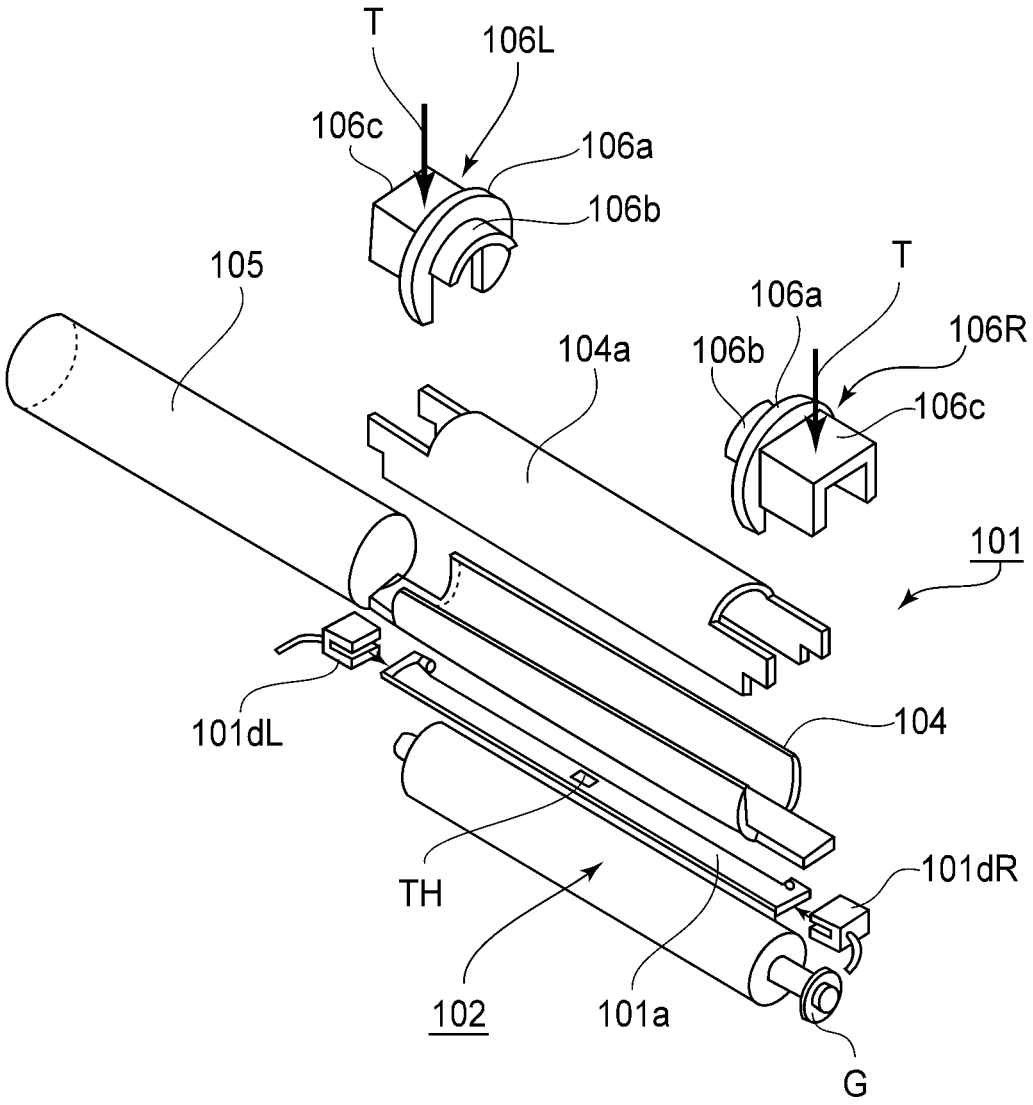
FIG. 2 is an exploded perspective view of a heating unit.

FIG. 2 is an exploded perspective view of the heating unit 101. It also shows the pressing roller 102. The heating unit 101 is an assembly comprising a heater holder 104, the planar heater 101*a*, a pressing stay 104*a*, an endless belt-like fixing sleeve 105 as a heating member, and sleeve flanges 106L, 106R provided at one end portion side and another end portion side.

The holder 104 is a trough like elongated member having a substantially half-arc cross-section and is made of a heat resistive resin material such as a liquid crystal polymer. The heater 101*a* is a plate-like elongated heat generating element having a low thermal capacity, such as a ceramic heater, the temperature of which can rise steeply by electric power supply thereto and is held by the holder 104 along the length of the holder in a central portion with respect to the circumferential direction at an outer side of the holder 104. The stay 104*a* is an elongated rigid member having a U-cross-section and disposed inside of holder 104 and is made of metal such as steel or the like. The sleeve 105 is loosely fitted around the assembly including the holder 104, the heater 101*a* and the stay 104*a*.

The flanges 106L, 106R provided at one end portion side and the other end portion side are molded products of heat resistive resin material having symmetrical configurations. The flanges 106L, 106R are holding members holding the sleeve 105. The sleeve 105 is rotatably held between the flanges 106L, 106R so that it is limited and kept in shape at the opposite ends.

As shown in FIG. 2, the flanges 106L, 106R each includes a flange portion 106*a*, a shelf portion 106*b* and an urged portion 106*c*. The flange portion 106*a* limits the movement of the sleeve 105 in a thrust direction of the sleeve 105 by being contacted by the end surface of the sleeve 105, and has an outer configuration larger than outer configuration of the sleeve 105 by a predetermined amount. The shelf portion 106*b* is provided on an inner surface of the flange portion 106*a* and is arcuate to hold the sleeve and keep the cylindrical shape thereof at the inner surface thereof at the end portion. The urged portion 106*c* is on the outer side of the flange portion 106*a* to receive an urging force T of an urging means (unshown).

Figure 6:
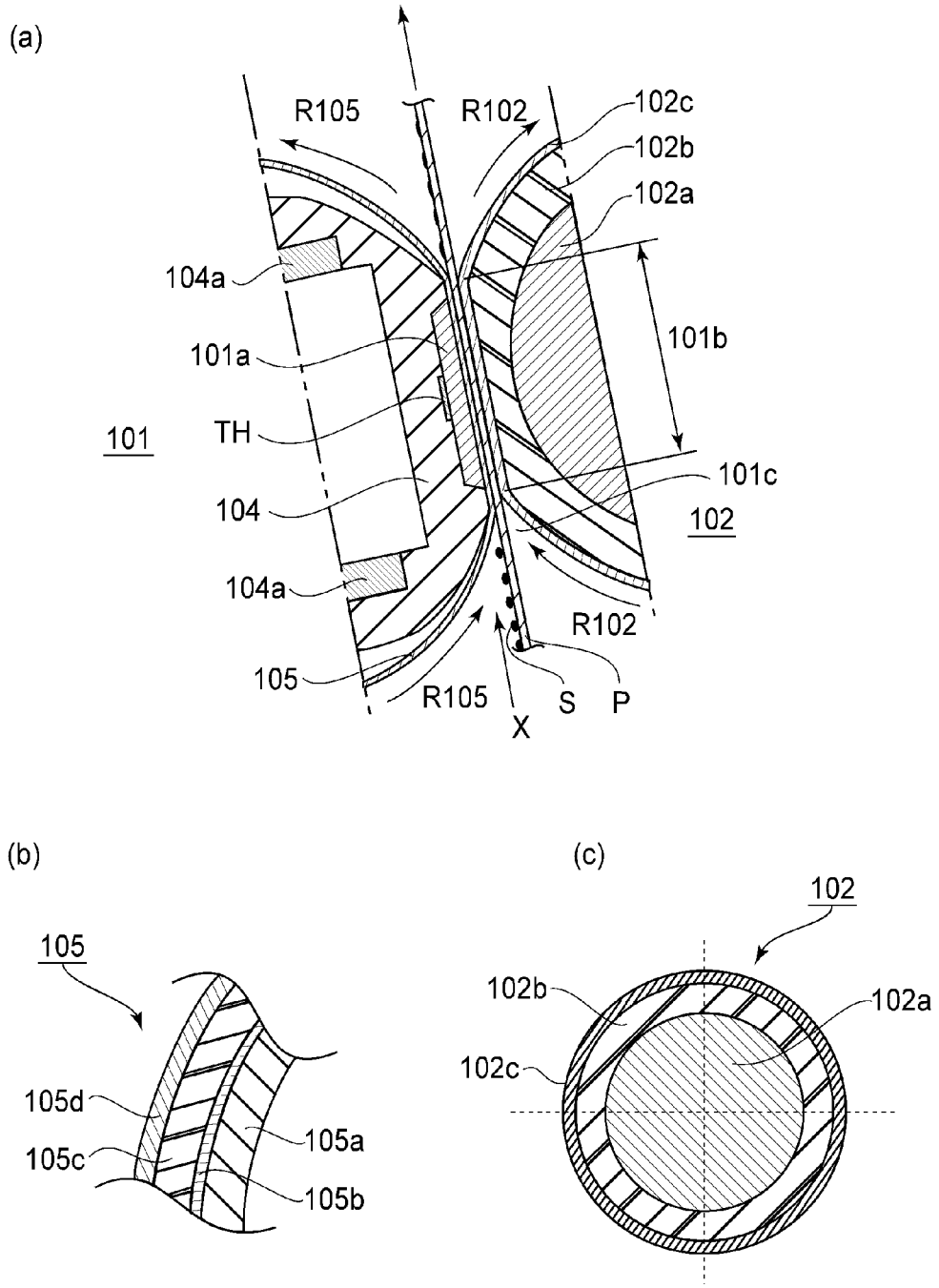
In FIG. 6, (a) is an enlarged view of a nip portion in part (a) of FIG. 1, and (c) is a schematic illustration of a layer of a pressing roller (b) is a schematic illustration of a layer of a sleeve.

FIG. 6(*b*) is a schematic illustration of the layer structure of the sleeve 105 in this embodiment. The sleeve 105 is a composite layer member including a laminated endless shape (cylindrical) base layer 105*a*, a primer layer 105*b*, an elastic layer 105*c* and a parting layer 105*d* in the order named from the inside toward the outside. The sleeve 105 is a thin and low thermal capacity member having an overall flexibility, and is substantially cylindrical in a free state.

The base layer 105*a* is a base layer of metal such as SUS (stainless steel), and in order to endure thermal stress and mechanical stress, it has a thickness of approx. 30 μm. The primer layer 105*b* on the base layer 105*a* is made of an approx. 5 μm thick electroconductive primer in which a proper amount of electroconductive particles such as carbon are dispersed.

The elastic layer 105*c* deforms, when pressing the toner image, to close-contact the parting layer 105*d* to the toner image. The parting layer 105*d* is made of PFA resin material which exhibits an excellent parting property and heat resistivity in order to assure a deposition suppressing property of the toner and the paper dust. The thickness thereof is approx. 20 μm from the standpoint of assuring the heat transfer property. The PFA resin material has an excellent parting property and the heat resistivity, but it is relatively easily damaged, too, and therefore, it is preferable that the sheet-like member 120 having the flexibility is contacted to the fixing sleeve 105 codirectionally with the peripheral moving direction of the fixing sleeve 105, as will be described hereinafter.

FIG. 6(*c*) schematically illustrates a layer structure of the pressing roller 102 in this embodiment. The pressing roller 102 is an elastic roller including a metal core 102*a* composed of metal (aluminum and steel), an elastic layer of silicone rubber or the like, and a parting layer 102*c* coating the elastic layer 102*b*. The parting layer 102*c* is a tube of fluorine resin material of PFA or the like and is fitted around the elastic layer. The circumferential length of the sleeve 105 and the circumferential length of the pressing roller 102 are substantially the same.

The casing 100 comprises an inner frame of an elongated metal plate including a base plate 109, a stay 108, one end portion side plate 107L, and another end portion side plate 107R. The casing 100 comprises an outer frame member mounted to the outside of the inner frame, the outer frame member of elongated heat resistive resin material including a rear cover 110, a first upper cover 111, a front lower cover 112, a second upper cover 113, one end portion side cover 117L, and another end portion side cover 117R. In FIG. 1B, parts such as the second upper cover 113 are omitted for better illustration.

The pressing roller 102 is rotatably supported between one end portion side plate 107L and the other end portion side plate 107R of the inner frame by the bearings (unshown), at the one end portion side and the other end portion side of the metal core 102*a*.

The heating unit 101 is extended in parallel with the pressing roller 102 between the one end portion side plate 107L and the other end portion side plate 107R of the inner frame with the heater (101*a*) side opposed to the pressing roller 102.

The flanges 106L and 106R at the one end portion side and the other end portion side of the heating unit 101 are slidably engaged with guiding holes formed (unshown) elongated toward the pressing roller 102 in the side plates 107L and 107R. The flanges 106L and 106R are urged toward the pressing roller 102 by urging means (unshown) at a predetermined urging force T.

By the urging force the entirety of the flanges 106L, 106R, the stay 104*a* and the holder 104 are moved toward the pressing roller 102. Therefore, the heater 101*a* is urged toward the pressing roller 102 through the sleeve 105 against an elasticity of the elastic layer 102*b* with a predetermined urging force. By this, a nip (fixing nip) 101*b* having a predetermined width measured in the recording material feeding direction X is formed between the sleeve 105 and the pressing roller 102. FIG. 6(*a*) is an enlarged view of the nip 101*b* in FIG. 1A.

The fixing operation of the fixing device 103 will be described. The control circuit portion A rotates the pressing roller 102 at a predetermined control timing at a predetermined speed in the clockwise direction indicated by an arrow R102 in FIG. 1A. The pressing roller 102 is rotated by a driving force transmitted from the driving source (unshown) to the driving gear G (FIG. 2) integral with the pressing roller 102.

By the pressing roller 102 being rotated, a rotational torque is applied to the sleeve 105 by a frictional force relative to the pressing roller 102 in the nip 101*b*. By this, the sleeve 105 is rotated in the counterclockwise direction indicated by an arrow R105 substantially at a speed corresponding to the speed of the pressing roller 102 around the holder 104 and the stay 104*a* while the inner surface thereof is sliding in close-contact with the heater 101*a*.

In addition, the control circuit portion A starts the electric power supply to the heater 101*a* from the voltage source portion (unshown). The electric power supply to the heater 101*a* is effected through electric power supply connectors 101*d*L, 101*d*R (FIG. 2) mounted to one end portion side and the other end portion side of the heater 101*a*. By the electric power supply, the temperature of the heater 101*a* rapidly rises all over the effective length thereof. The temperature rise is detected by a thermister TH as temperature detecting means provided on a back side (side opposite the nip 101*b* side) of the heater 101*a*.

The control circuit portion A controls the electric power supply to the heater 101*a* so that the heater temperature detected by the thermister TH is raised to and maintained at a predetermined set target temperature. In this embodiment, the set target temperature is approx. 170 degree C.

In such a state of the fixing device, the sheet P carrying an unfixed toner image is fed from the secondary transfer portion to the fixing device 103. The sheet P is guided along the feeding guide 130*b* and the guide surface 110*a* of the rear cover 110 and is introduced to the entrance 101*c* of the nip and is nipped and fed by the nip 101*b*.

The sheet P is heated with the heat of the heater 101*a* through the sleeve 105 while being nipped and fed by the nip 101*b*. The unfixed toner image S is melted by the heat of the heater 101*a*, and is fixed by the pressure applied in the fixing nip 101*b* into a fixed image (heat-pressure fixing). The sheet P discharged from the nip 101*b* is conveyed to an outside of the fixing device 103 by the fixing and sheet discharging roller pair 118.

The casing 100 of the fixing device 103 is provided with a sealing member 120. The sealing member 120 has one end, with respect to the recording material feeding direction X, which extends toward the sleeve 105 to close the gap between the casing 100 and the sleeve 105. The other end of the sealing member 120 extends to oppose to the surface of the feeding guide 130*b* to block the space existing upstream of the nip 101*b* (with respect to the recording material feeding direction X) from the air flow 28 (FIG. 4).

More specifically, the sheet-like member 120 having a flexibility as the sealing member is stuck on the sticking surface of the front lower cover 112 of fixing device 103, and one end portion thereof is in contact with the sleeve 105. The sheet-like member 120 is made of a fluorinated resin material having both of a heat resistivity, a slidability and an elasticity, and is urged to the sleeve 105 by the elastic force thereof to seal between the front lower cover 112 and the sleeve 105.

The sheet-like member 120 is inclined relative to a perpendicular direction to the surface of the sleeve 105, and the sleeve 105 side end portion of the sheet-like member 120 is co-directional with the peripheral moving direction of the sleeve 105. Because of the co-directional arrangement, the load applied to the sleeve 105 is reduced to suppress the damage to the surface thereof.

On the other hand, as shown in FIGS. 3 and 4, the other end portion side of-the sheet-like member 120 extends to oppose the feeding guide 130*b* and projects to the neighborhood of the belt 10*c* of the transfer unit (image forming station) 10 with a gap therefrom. As described hereinbefore, adjacent to the feeding guide 130*b*, the air flow 28 (FIG. 4) is provided to maintain the temperature of the image forming station at or below a predetermined temperature. The other end portion side of-the sheet-like member 120 substantially blocks the air flow 28 so as not to produce air flow at least in the neighborhood of an upstream part of the nip 101*b* (neighborhood of the upstream part with respect to recording material feeding direction).

A predetermined gap is provided between the belt 10*c* and the sheet-like member 120 not to positively contact them to each other, by which the load applied to the belt 10*c* is lowered to prevent the damage to the surface of the belt 10*c*.

FIG. 5 is an illustration of the state in which the right-hand door 130 is opened about the rotational shaft 130*a* for the jam clearance or maintenance operation. When the fixing device 103 is taken out for maintenance operation, the fixing device 103 is pulled out of the main assembly 1A of the apparatus in the direction of an arrow 27, and in order to carry out the mounting and demounting operation using a small space, the other end portion side of the sheet-like member 120 desirably has an elasticity (flexibility).

In this embodiment, a free end, which is one end portion of the sheet-like member 120, is contacted to the fixing sleeve 105, and the other end portion projected from the fixing device 103 is also a free end, while the stick portion 112*a* thereof is stuck on the lower front cover 112. Therefore, it is flexible in the direction of an arrow 29. With such a structure, operativity is improved when the sheet is taken out for an upstream side of the fixing nip 101*b* for the purpose of jam clearance.

The distance from the feeding guide 130*b* to the sheet-like member 120 is such that the sheet-like member 120 is spaced therefrom by at least 10 mm. This is because if an obstructing material exists opposing the feeding guide 130*b*, the unfixed image of the sheet which is being fed to the fixing device 103 may rub the obstructing material due to the possible curling or fluttering, with the result of the occurrence of an image defect.

Figure 7:
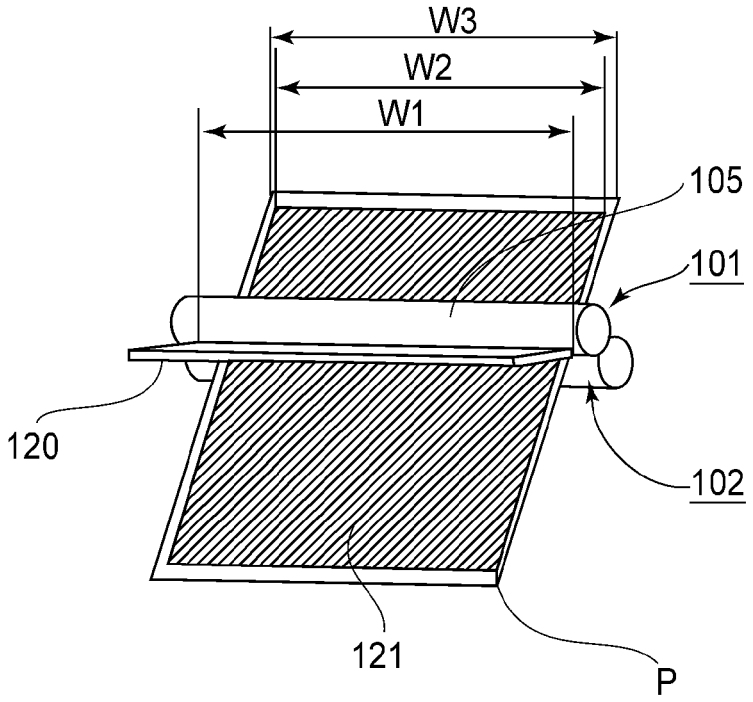
FIG. 7 illustrates relationship between a passing region width of a toner image, a maximum feeding width of the sheet, a region width of a sheet-like member.

In addition, as shown in FIG. 7, a dimension W1 (width with respect to the sheet feeding direction) of the sheet-like member 120 measured in the longitudinal direction of the sleeve 105 will be described. It is larger than a maximum printing area width W2 (entire area of the passing range of the toner image 121 (S)) printed on the sheet in the nip 101*b* at least.

The passing range of the toner image 121 is a maximum width of the toner image 121, that is, more particularly, the a width of the image 121 having a largest printable width. Therefore, W1>W3>W2 is satisfied.

In this embodiment, W1>W3 is satisfied, too, where W3 is a width of the maximum sheet (maximum feeding width of the sheet) and is slightly larger than the maximum printing width W2. That is, the width W1 of the sheet-like member 120 is larger than the maximum feeding width W3 of the sheet P. With such a structure, the dust produced in the passing range of the toner image in the nip 101*b* can be blocked assuredly from the air flow 28 (FIG. 4).

(3) Parting Wax Contained in Toner Particle:

Parting wax (parting material) contained in toner particle S will be described. In the image forming apparatus 1 using the toner S as in the printer, the toner S may be deposited onto the sleeve 105 (toner offset). The offset toner may cause various problems such as an image defect and/or variation in the temperature of the nip 101*b*.

Under the circumstances, in the image forming apparatus 1 of this embodiment, the parting wax as a parting material is contained in the toner particles S so that the parting wax seeps from the toner particles S in the heating and fixing operation. The parting wax melted by the heating functions to prevent offset by intervening between the sleeve 105 and the toner image on the sheet P.

The melting point Tm of the parting wax is approx. 75 degree C. The melting point Tm is selected so that the parting wax in the toner S instantaneously melts to seep into the interface between the toner image and the sleeve 105 when the nip 101*b* is kept at the set target temperature 170 degree C., When the parting wax melts, a part of the parting wax such as low molecular weight component in the parting wax gasifies. The parting wax comprises long chain components, but the lengths thereof are not uniform, and have a predetermined distribution. More particularly, the parting wax comprises a low molecular component having short chains and a low boiling point, and a high molecular component having long chains and a high boiling point, in which the low molecular component gasifies.

The gasified wax component is cooled in the air to condense into dust particles having sizes of approx. several tens-several hundreds nm. The wax component dust is sticky and may stick on inside parts of the image forming apparatus 1, which may cause problems. For example, if the dust is deposited and accumulated on the fixing and sheet discharging rollers 118 or the discharging rollers, the contamination may be transferred onto the sheet P, thus causing a deterioration in the image quality. For another example, in the case that the image forming apparatus 1 is provided with a discharging filter, the dust may be deposited on the discharging filter to clog up.

Under the circumstances, in the fixing device 103 of this embodiment, the sheet-like member 120 is provided between the lower front cover 112, which is a part of the casing 100, and the sleeve 105, which is the heating member, to seal therebetween, thus suppressing scattering of the dust in the main assembly 1A of the apparatus.

For better understanding of the function of the sheet-like member 120, the general property of the dust, and the consideration of the inventors will be described.

Figure 8:
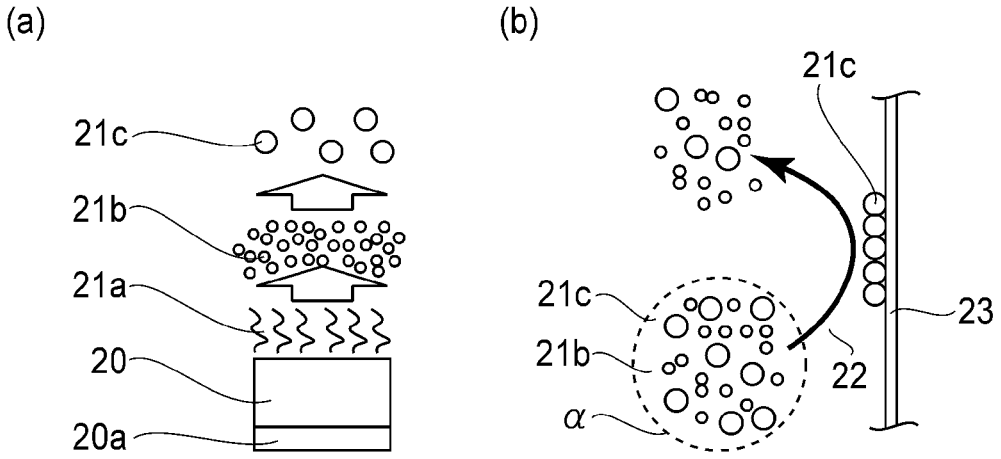
FIGS. 8(*a*) and 8(*b*) illustrate a dust coalescing and deposition phenomena.

It is known as general properties of the dust that they coalesce into large particles and that they are deposited on a solid matter in the flow of the dust. FIGS. 8(*a*) and 8(*b*) illustrate these properties As shown in FIG. 8(*a*), a high boiling point substance 20 having the boiling point 150-200 degree C. is placed on a heating source 20*a*, and is heated to approx. 200 degree C., by which the high boiling point substance volatiles into volatilized matter 21*a*. When the volatile matter 21*a* contacts the normal temperature air, the temperature of the volatile matter 21*a* immediately decreases to below the boiling point temperature to condense in the air, by which it becomes fine dust 21*b* of approx. several nm-several tens nm. This phenomenon is the same as the water vapor condensing into fine droplets when the temperature thereof becomes lower than the due-point temperature.

The fine dust 21*b* is moving in the air by the Brownian movement, and they collapse each other to coalesce into larger dust particles 21*c*, as is known. The growth ends when the dust size exceeds a certain size because when the dust particles become large, the Brownian movement becomes less active.

Consider the case shown in FIG. 8(*b*) in which the air α containing fine dust 21*b* and larger dust particles 21*c* flows against the wall 23 by the air flow 22. At this time, the large dust particles 21*c* are more easily deposited on the wall 23 than the file dust particles 21*b*. Dust particles 21*c* have large inertia, and therefore, impinge on the wall 23 strongly. This occurs also when the air flow speed is as low as is not more than 0.2 m/s, which is outside the measurement limit of an ordinary anemometer.

As will be understood from the foregoing, the nature of the dust is to coalesce into large particles, and the nature of large dust particles is that they are susceptible to easy deposition on the parts. The tendency to coalesce depends on the temperature and the density of the dust particles. For example, the coalescence increases when the temperature of the sticky component becomes high, and it becomes soft, and the collision probability of the dust particles increases under a high density.

Considering the suppressing measurement of the dust scattering in the image forming apparatus 1 in the light of the nature of such coalescence and dust particles, it is preferable to confine the air containing the dust particles in the region in the neighborhood of the sleeve 105. The neighborhood of the sleeve 105 is close to the position of the production of the dust particles, and therefore, the dust density is high, and in addition, the ambient temperature is high due to the heat of the surface of the sleeve 105, and for these reasons, the situation is proper for coalescence of the dust particles.

Figure 9:
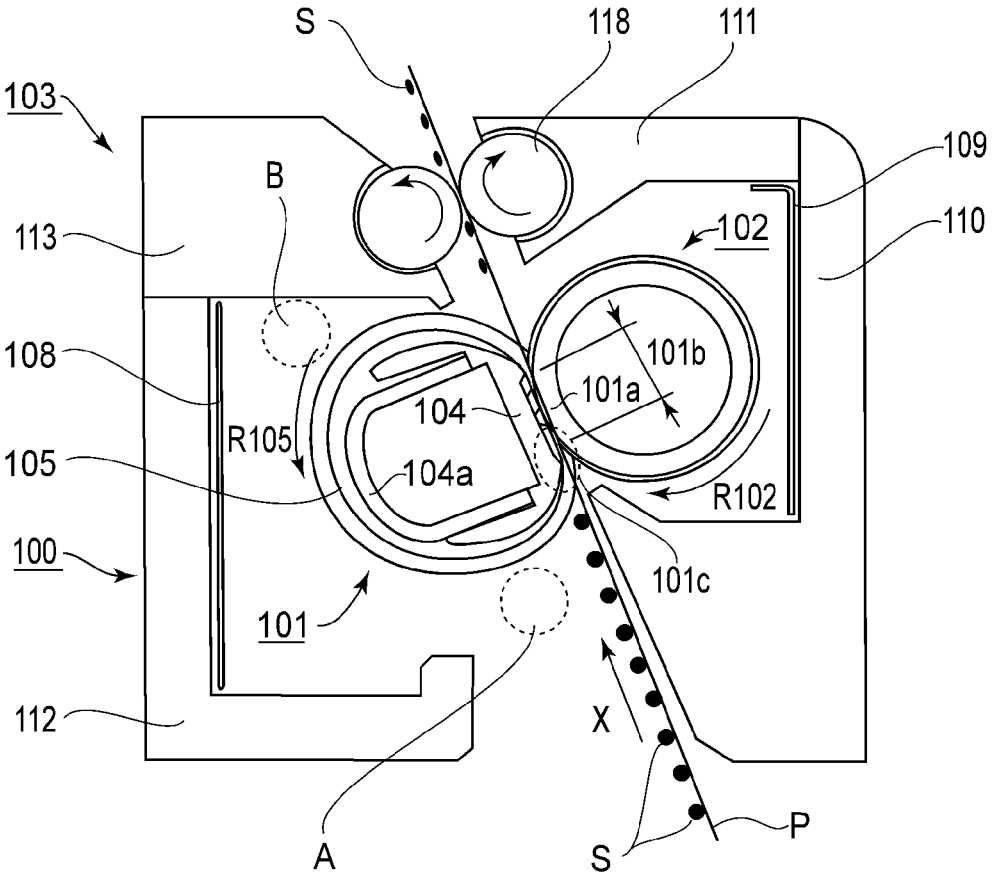
FIG. 9 illustrates a dust producing position.
Figure 10:
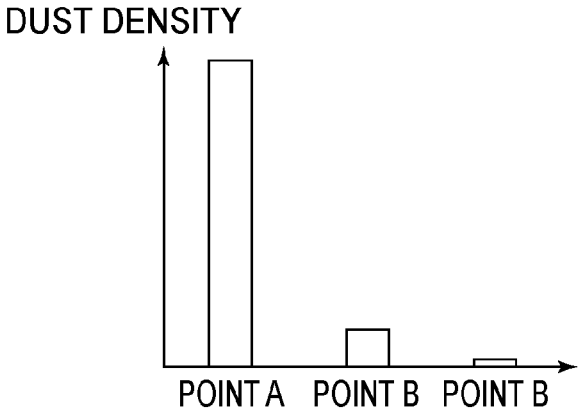
FIG. 10 is a graph of dust density in the neighborhood of the sleeve.

Referring to FIG. 9 and FIG. 10, the position of the production of the dust particles will be described. FIG. 9 shows the fixing device 103 in which the sheet-like member 120 has been removed. The sheet P carrying the toner image is fed and fed by the nip 101*b*. Therefore, the dust particles are produced. In such a state, the dust density has been measured at a point A adjacent the inlet 101*c* of the nip 101*b* and at a point B adjacent the outlet.

For the measurement, a high speed response particle sizer FMPS available from TSI Corporation, USA was used. The prediction before the actual measurement had been that the density would be relatively higher at the outlet side where the toner image has been sufficiently by the nip 101*b*, but the result was the opposite. The result of measurement was that the position of the production of the dust particles is at the inlet 101*c* of the nip. It is considered that this is because a low molecular weight component of the parting wax is volatilized instantaneously when the high temperature sleeve 105 contacts the toner image, and after having passed through the nip 101*b*, the volatilization has been finished.

Figure 11:
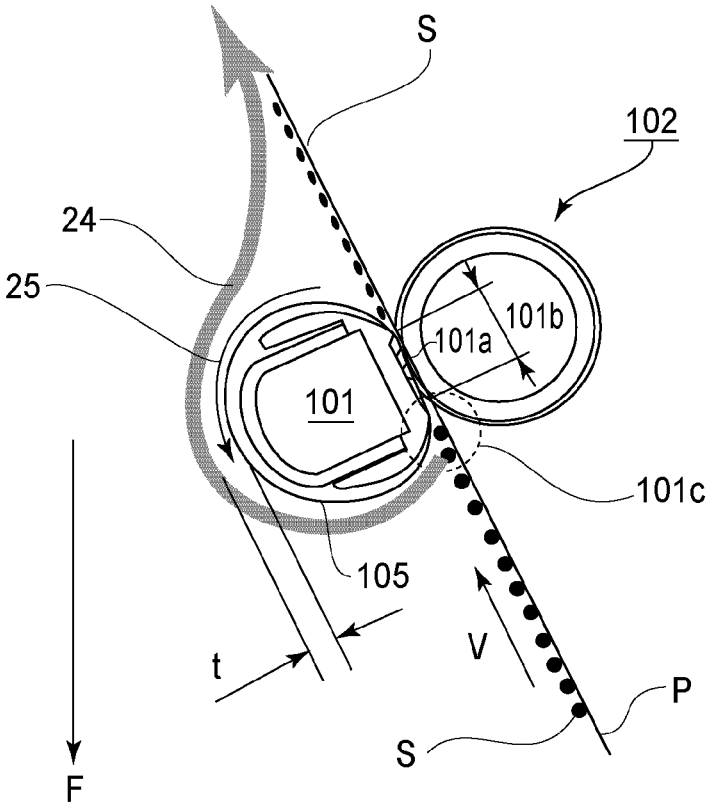
FIG. 11 is an illustration of air flow in the neighborhood of the sleeve.

Referring to FIG. 11 showing a result of simulation, diffusion of the dust particles produced at the inlet 101*c* of the nip, inside of the machine will be described. FIG. 11 shows the flow of the air from the neighborhood of the nip inlet 101*c* along a path 24. An arrow F in FIG. 11 is the direction of gravity.

The simulation of the heating and the air flow has been made under the conditions of 170 degree C. at the surface temperature of the sleeve 105, the rotation in the counter-clockwise at a speed V, and the sheet P speed of V upwardly in FIG. 11. In the simulation, an ascending air flow due to natural convection around of sleeve 105, and a film surface air flow 25 caused by the movement of the surface of the sleeve 105 are taken into account. The path 24 has been determined by producing a phantom particle having a zero weight at the nip inlet 101*c* on the simulation program. The method is well used to investigate an air flow path in an air flow simulation.

The phantom particle of the zero weight does not have an inertia, and cannot replicate the diffusion by the Brownian movement of actual particles, but quite replicates the discharging flow path of the dust particles.

According to the path 24 shown in FIG. 11, the dust particles produced at the nip inlet 101*c* move in the clockwise direction along the surface of the sleeve 105 and rise rises through the gap adjacent the roller pair 118 along the sheet P. Between the sleeve 105 and the path 24, a gap t exists. The gap t is provided by the sleeve surface air flow 25 entering between the path 24 and the sleeve 105.

As described in the foregoing, it is considered that the positions of the production of the dust particles and the coalescence and deposition of the dust particles are at the nip inlet 101*c*, and the produced dust particles move along the surface of the sleeve 105. The sheet-like member 120 shown in FIGS. 1A and 1B is provided on the basis of this consideration and has a function of stagnating the dust particles in the region 26 by shutting the flow of the rising dust particles along the surface of the sleeve 105. It has an additional function, that is, of not diffusing the dust particles stagnated in the range 26 in the image forming apparatus against the air flow 28 of FIG. 4.

In a bar graph of FIG. 10, the right-hand end data indicates the dust density at the point B (FIG. 9) in the case that the sheet-like member 120 is provided. As compared with the case not having the sheet-like member 120, the dust density at the point B was reduced to approx. ⅕. As a result, the diffusion of the dust particles in the image forming apparatus can be suppressed to reduce the image contamination and/or the filter packing.

Dust particles are prevented from moving between the casing 100 and the sleeve 105 by the sheet-like member 120, and stagnate in the region 26 shown in FIG. 1A. The temperature and the density of the stagnated dust particles there are so high that the coalescence of them is rapid. The dust particles upsized by the coalescence move toward the sleeve 105 by the rising air flow caused by the natural convection and by the movement of the sheet P. The deposited dust particles melt by the heat of the sleeve 105 and are deposited on the sheet P, but since the dust particles are so fine, the influence on the image is practically negligible.

That is, the portion of the sheet-like member 120 between the sleeve 105 and the casing 100 confines in the neighborhood of the nip, the dust particles produced adjacent to the nip 101*b*. The enclosed dust particles coalesce and upsize and are deposited on the rotating sleeve 105. The dust particles deposited on the sleeve 105 are transferred onto the sheet, but do not influence the image because their size is sufficiently small.

In addition, by extending the other end portion side of the sheet-like member 120 to the neighborhood of the transfer unit 10, the peripheral portion of the nip is blocked (partitioned) from the ventilation air flow 28. Therefore, the wide range diffusion of the dust particles in the image forming apparatus can be suppressed.

Embodiment 2

Figure 12:
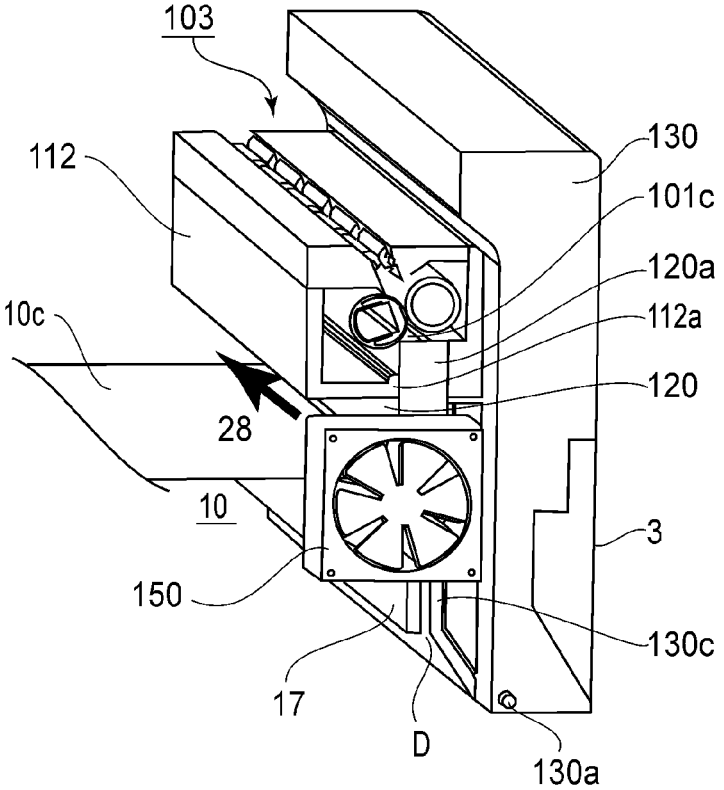
FIGS. 12(*a*) and 12(*b*) illustrate a fixing device according to Embodiment 2.
Figure 12:
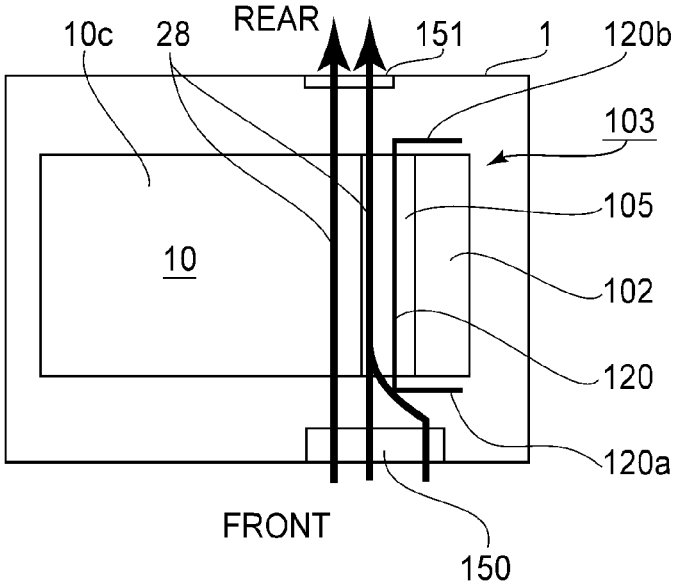

Referring to FIG. 12, a fixing device 103 according to Embodiment 2 will be described. The apparatus is different from the fixing device 103 of Embodiment 1 in the following respects. One end portion side and another end portion side with respect to a widthwise direction (sheet widthwise direction) of the sheet-like members 120 as a sealing member are provided with respective wall surface portions 120*a* and 120*b* bent toward a feeding guide 130*b* opposing the sheet-like member 120. The sheet-like member 120 extends over a range width W1 wider than the maximum feeding width W3 of the sheet P. Wall surface portions 120*a* and 120*b* bent toward the feeding guide 130*b* are provided at least at one end portion side with respect to the widthwise direction of the sheet-like member 120.

Figure 15:
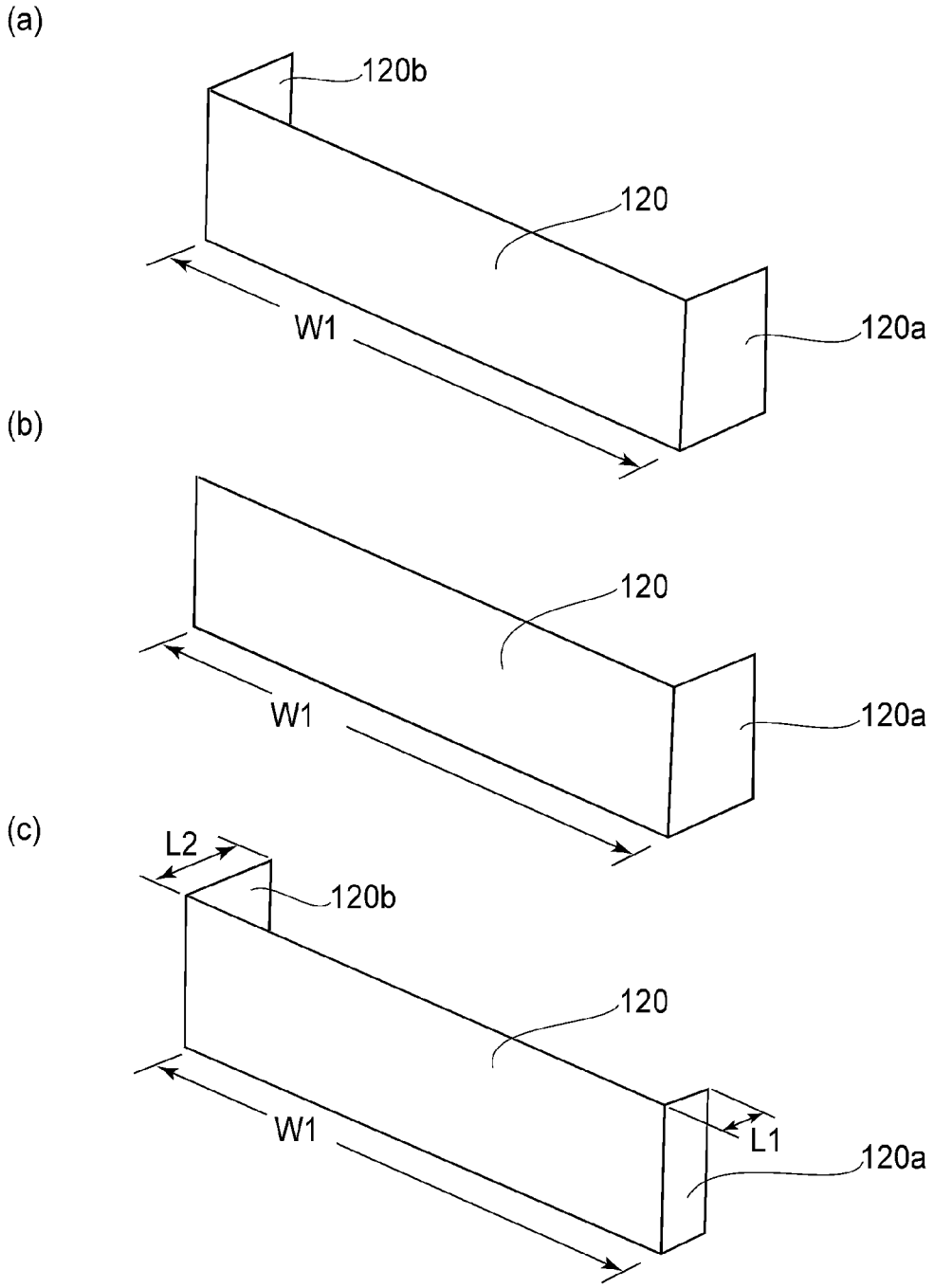
In FIG. 15, (a), (b) and (c) are perspective views of sheet-like members used in the fixing devices of Embodiments 2, 3 and 4.

FIG. 15(*a*) is a perspective view of the sheet-like member 120 provided with the wall surface portions 120*a* and 120*b*. In the description of this embodiment, the same reference numerals as in Embodiment 1 are assigned to the elements having the corresponding functions in this embodiment, and the detailed description thereof is omitted for simplicity.

FIG. 12(*a*) is a perspective view of major parts of the apparatus of Embodiment 2, FIG. 12(*b*) is a schematic view of the major parts as seen from above the main assembly of the apparatus. On a stick surface 112*a* of the lower front cover 112, the sheet-like member 120 is stuck, and the sheet-like member 120 covers the region W1, which is larger than the maximum feeding width W3. The opposite end portions of the sheet-like member 120 with respect to the widthwise direction are provided with the wall surface portions 120*a* that are integrally bent.

A fan 150 as the air flow forming means is disposed closer to the inlet 101*c* of the fixing nip than in Embodiment 1. With this structure, air flow 28 includes the flow in the path along the surface of the belt 10*c* from a sheet feeding path to a secondary transfer portion and a fixing device 103, and the flow in the path from a front side of the image forming apparatus 1 directly to and through a louver 151 provided in a rear surface across the sheet feeding path.

In this embodiment, the inlet 101*c* of the nip can be blocked from the air flow 28 entering from a lateral side of the sheet feeding path by the wall surface portions 120*a* and 120*b* of the sheet-like member 120. More particularly, the dust particles produced in the nip inlet 101*c* are effectively stagnated in a space portion surrounded by the sleeve 105, the pressing roller 102, the sheet-like member 120, the wall surface portions 120*a* and 120*b*, and the feeding guide 130*b*. As a result, the diffusion of the dust particles in the image forming apparatus can be suppressed to reduce the image contamination and/or the filter packing.

Embodiment 3

Figure 13:
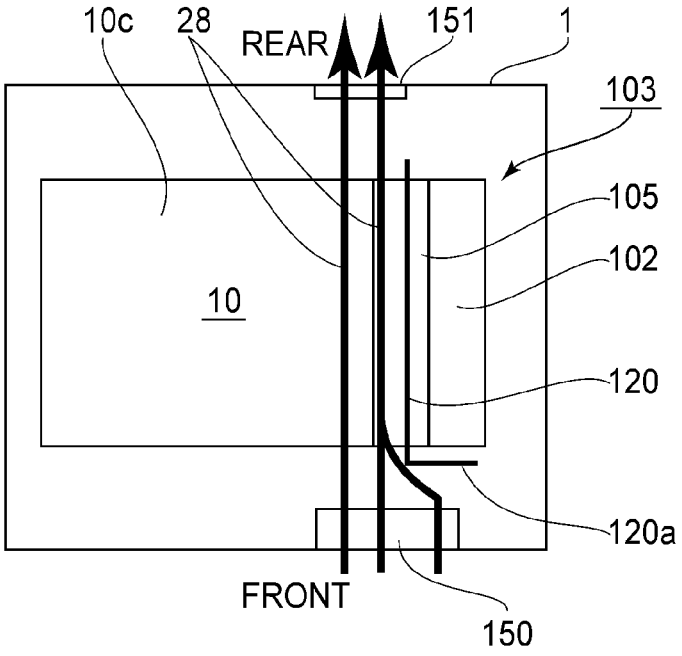
FIG. 13 is an illustration of a fixing device according to Embodiment 3.

Referring to FIG. 13, a fixing device 103 according to Embodiment 3 will be described. The fixing device of this embodiment is different from the fixing device 103 of Embodiment 2 in that only at one end portion side of the sheet-like member 120 with respect to the widthwise direction (sheet widthwise direction) is a sealing member, with a wall surface portion 120*a* bent toward the feeding guide 130*b* opposing the sheet-like member 120. FIG. 15(*b*) is a perspective view of the sheet-like member 120 is provided with the wall surface portion 120*a*. In the description of this embodiment, the same reference numerals as in Embodiment 1 are assigned to the elements having the corresponding functions in this embodiment, and the detailed description thereof is omitted for simplicity.

FIG. 13 is a schematic view of major parts of the apparatus according to Embodiment 3 as seen from above a main assembly of the apparatus. The sheet-like member 120 extends over a range width wider than the maximum feeding width W3 of the sheet P. The one end portion of the sheet-like member 120 with respect to the widthwise direction is provided with a wall surface portion 120*a* that is integrally bent. On the other hand, the other end portion is not provided with a wall surface portion.

In this embodiment, the inlet 101*c* of the fixing nip can be blocked from a high speed air flow 28 entering from the front side of the image forming apparatus 1, by the wall surface portion 120*a* of the sheet-like member 120.

According to this embodiment, too, the diffusion of the dust particles in the image forming apparatus can be suppressed to reduce the image contamination and/or the filter packing. In the case of this embodiment, the other end portion side of the sheet-like member 120 where the air flow speed is almost zero is opened, so that the moisture of the sheet feeding path can be properly discharged. As a result, the improper feeding and/or the image defect attributable to the dew condensation can be avoided.

Embodiment 4

Figure 14:
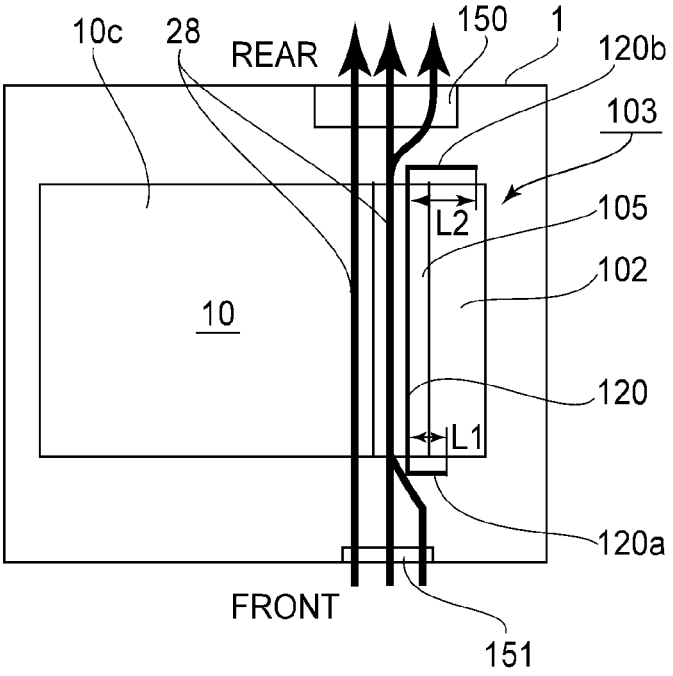
FIG. 14 is an illustration of a fixing device according to Embodiment 4.

Referring to FIG. 14, a fixing device 103 according to Embodiment 4 will be described. In this embodiment, one end portion side and another end portion side with respect to a widthwise direction (sheet widthwise direction) of the sheet-like members 120 as a sealing member are provided with respective wall surface portions 120*a* and 120*b* bent toward a feeding guides 130*b* and 110*a* opposing the sheet-like member 120. The heights of the wall surface portions 120*a* and 120*b* (lengths in the direction toward the feeding guides 130*b* and 110*a*) are made different from each other. FIG. 15(*c*) is a perspective view of the sheet-like member 120 provided with such wall surface portions 120*a* and 120*b*.

In the description of this embodiment, the same reference numerals as in the foregoing Embodiments are assigned to the elements having the corresponding functions in this embodiment, and the detailed description thereof is omitted for simplicity.

FIG. 14 is a schematic view of major parts of the apparatus according to Embodiment 4 as seen from above a main assembly of the apparatus. The sheet-like member 120 extends over a range width wider than the maximum feeding width W3 of the sheet P. The one end portion of the sheet-like member 120 with respect to the widthwise direction is provided with wall surface portion 120*a* (having a height L1) that are integrally bent. On the other hand, the other end portion side is provided with an integrally bent wall surface 120*b* having a height L2. Here, L1<L2.

In addition, as is different from the foregoing embodiments, a fan 150, which is the air flow forming means, is provided at a rear surface of the image forming apparatus 1, and a louver 151 is provided at a front side of the image forming apparatus 1, wherein the air is sucked from the rear surface. In this embodiment, the height L2 of the wall surface portion 120*b* at the other end portion side of the sheet-like member 120 is higher than the height L1 of the wall surface portion 120*a* at the one end portion side. Therefore, the inlet 101*c* of the fixing nip can be blocked from the rear surface of the image forming apparatus 1 where the air flow speed is particularly high.

More particularly, the wall surface portions 120*a* and 120*b* are provided at the one end portion side and the other end portion side with respect to the widthwise direction of the member 120, and the height provided by the bending toward the feeding guide 130*b* of the wall surface portion 120*b* at the main entering side of the air flow 28 is higher than that of the other wall surface portion 120*a*.

According to this embodiment, too, the diffusion of the dust particles in the image forming apparatus can be suppressed to reduce the image contamination and/or the filter packing. The front side of the image forming apparatus 1 where the air flow speed is very low is opened, so that the moisture of the sheet feeding path can be properly discharged. As a result, the improper feeding and/or the image defect attributable to the dew condensation can be avoided.

In this embodiment, it will suffice if the sheet-like member 120 contacts the sleeve 105 by which movement of the dust particles is prevented, and the continuous sheet-like member 120, which is continuous without a gap, extends to the upstream side of the nip to block from the air flow in the neighborhood of the nip inlet. As long as these functions are provided, the sheet-like member 120 is not limited to those explained in Embodiments 1-4.

Embodiment 5

Figure 16A:
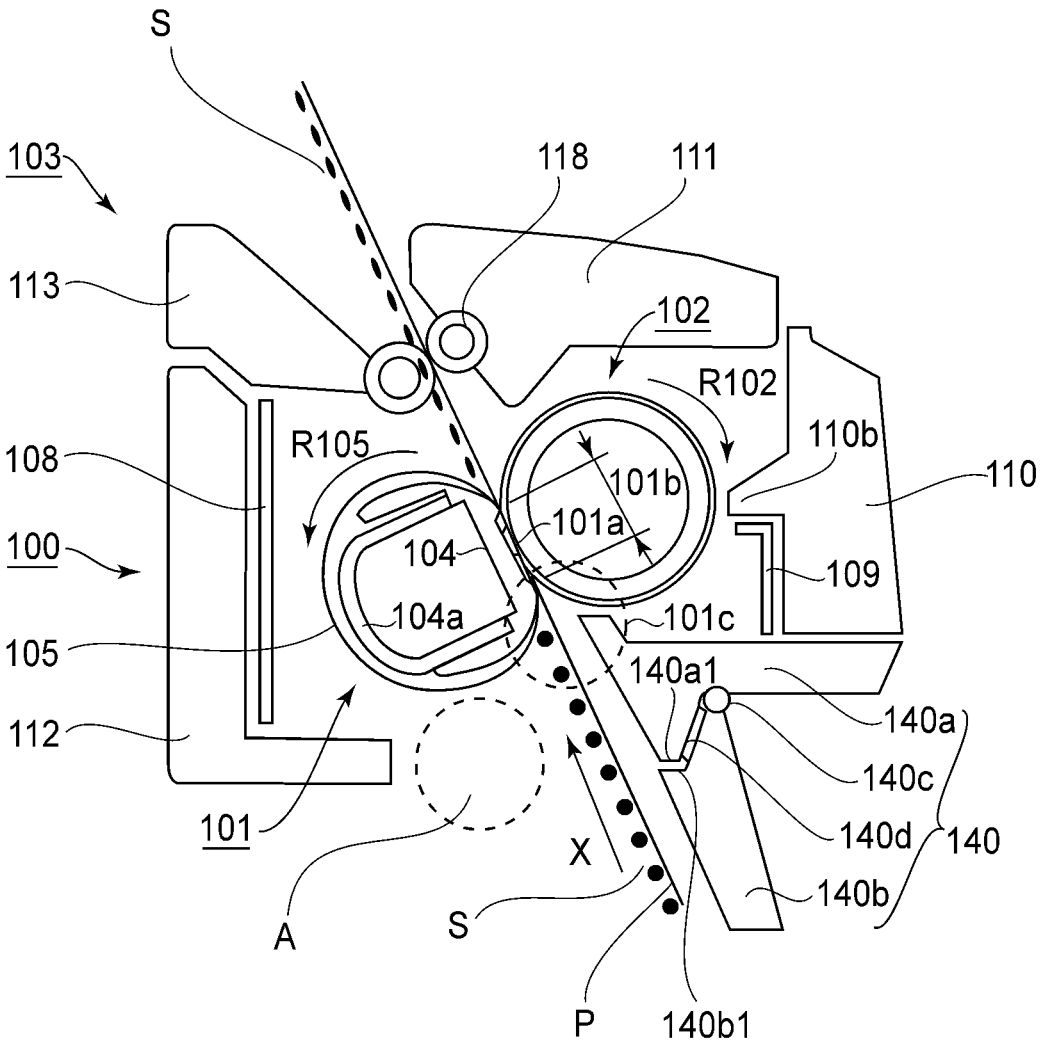
FIG. 16A is a schematic cross sectional view of a fixing device according to Embodiment 5.
Figure 16B:
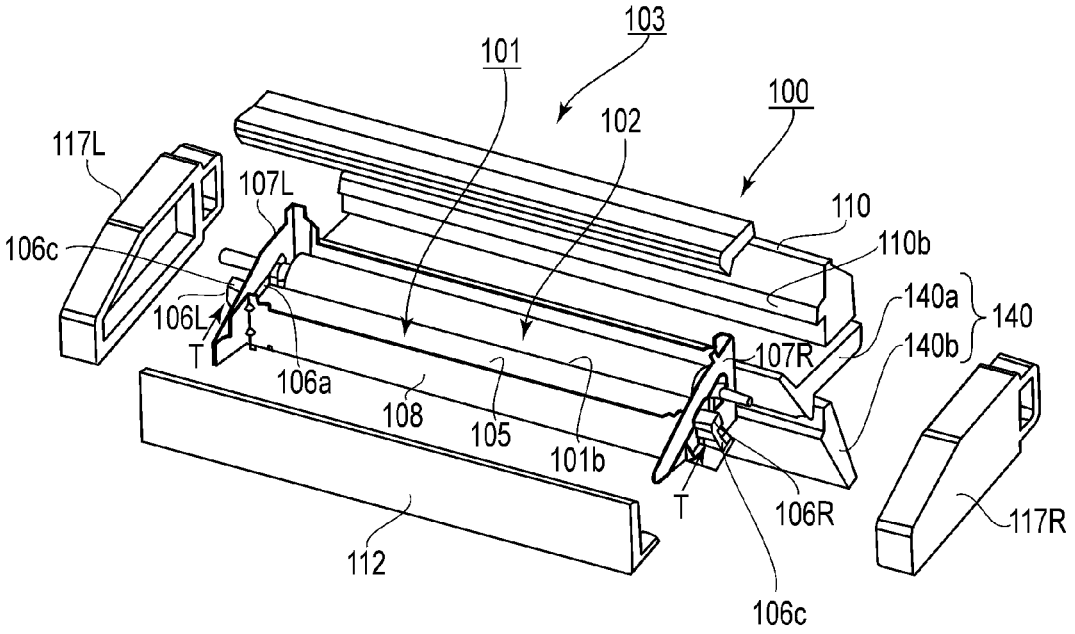
FIG. 16B is an exploded perspective view of the fixing device.

FIG. 16A is a schematic cross sectional view of the fixing device 103 in this embodiment, and FIG. 16B is an exploded perspective view of the fixing device 103. In the description of this embodiment, the same reference numerals as in Embodiments 1-4 are assigned to the elements having the corresponding functions in this embodiment, and the detailed description thereof is omitted for simplicity.

In the fixing device 103 of this embodiment, a casing 100 is provided with a first neighborhood 110*b*, which extends to a neighborhood of the pressing roller 102 and which has a length larger than a maximum printing area width W2 (FIG. 7) of the sheet P introduced to a nip 101*b*. In this embodiment, the first neighborhood 110*b* extends in the widthwise direction of the rear cover 110 inside the rear cover 110 mounted on the outside of an inner frame of the casing 100.

In the fixing device 103 of this embodiment, there is provided a feeding guide 140, which is disposed upstream of the nip 101*b* with respect to the recording material feeding direction X and which guides a side of the sheet P opposite from toner image carrying side toward the nip 101*b*. The feeding guide 140 is provided with a second neighborhood (guide frame) 140*a* which extends to a neighborhood of the pressing roller 102 to guide the sheet P to the nip 101*b*. The portion of the feeding guide 140 upstream of the second neighborhood 140*a* with respect to the recording material feeding direction X is called an upstream portion 140*b* of the feeding guide.

In the fixing device 103 of this embodiment, a sheet-like member 120 as with Embodiments 1-4 is provided, although not shown in the drawing.

As described hereinbefore, the dust particles are produced by the toner S on the sheet, being heated by the nip 101*b* of the fixing device 103, and therefore, they are mainly produced at a point A in FIG. 16A, which is upstream of the nip 101*b* with respect to the recording material feeding direction X. The dust particles produced at point A diffuse inside of the machine with the air flow therearound.

As described hereinbefore, it is preferable to confine the air containing the dust particles in the neighborhood of the point A (producing position) by which they are stagnated there in a high density to promote the coalescence of the dust particles. The neighborhood of the sleeve 105 and the pressing roller 102 is close to the position of the production of the dust particles, and therefore, the dust density is high, and the ambient temperature is also high due to the heat of the surface of the sleeve 105, and for this reason, the neighborhood is suitable for the coalescence of the dust particles.

In view of these, in this embodiment, the dust particles are confined in the neighborhood of the producing point A to promote the coalescence of the dust particles, thus preventing scattering of the dust particles in the inside of the machine, and this is accomplished by the provision of the feeding guide 140 upstream of the rear cover 110 and the nip 101*b* with respect to the recording material feeding direction X. The structures of the fixing device 103 according to this embodiment will be described.

The rear cover 110 is provided with a dust blocking rib (first neighborhood) 110*b* close to the pressing roller 102. The width of the blocking rib 110*b* in the longitudinal direction of the pressing roller 102 is wide enough to cover the entire area W2 (FIG. 7), in the nip 101*b*, of the passing range of the toner image printed on the sheet P. Between the blocking rib 110*b* and the pressing roller 102, a gap is provided to prevent wearing of them.

Figure 17:
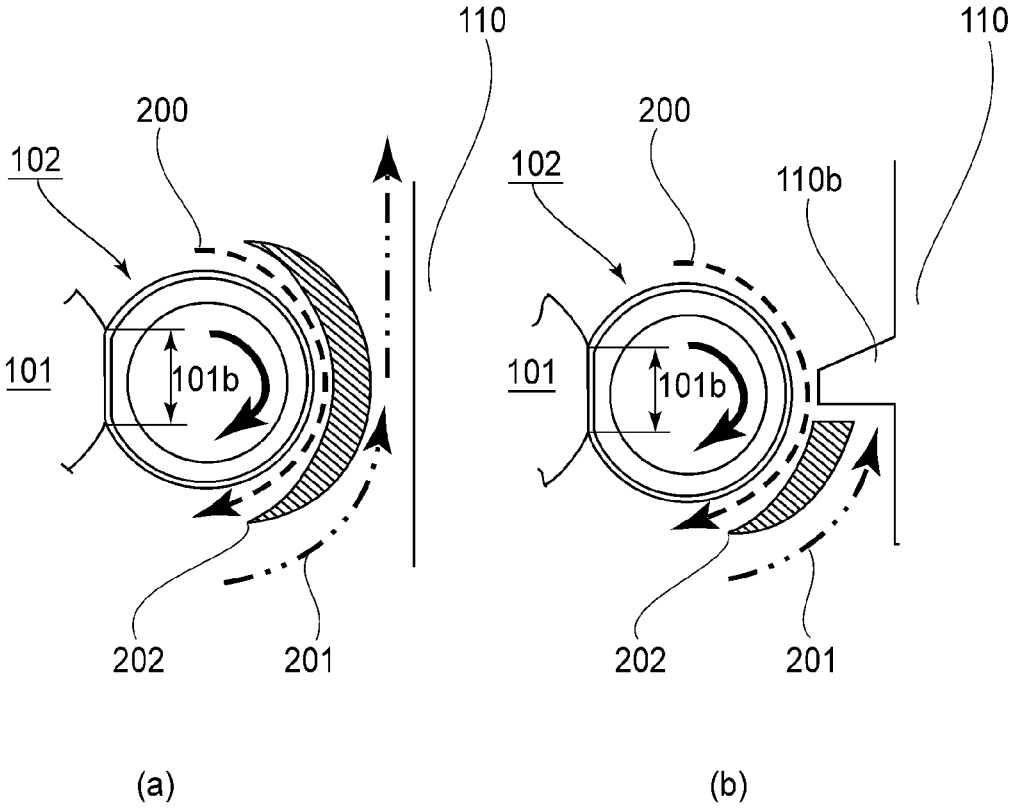
FIG. 17 is a schematic view illustrating an air flow adjacent to the pressing roller.

FIGS. 17(*a*) and 17(*b*) are illustrations of the air flow between the pressing roller 102 and the rear cover 110.

FIG. 17(*a*) shows the case in which the rear cover 110 is not provided with the dust blocking rib 110*b* close to the pressing roller 102. In this case, the pressing roller 102, which is a rotatable member, produces a rotation air flow 200 along the rotational moving direction at the surface when the pressing roller 102 rotates. In addition, between the rear cover 110 and the pressing roller 102, a rise air flow 201 is produced by the air heated by the heat generated by the heating unit 101. In a nip opposing side of the pressing roller 102 where the directions of the rotation air flow and the rise air flow are opposite to each other, the air flow 200 and the air flow 201 collapse each other, so that a substantially no-airflow space 202 is produced.

Because the dust particles are so light, they move with the air flows 200 and 201. The dust particles carried by the rotation air flow 200 are returned to the nip 101*b*, and the dust particles carried by the rise air flow leak to the outside of the fixing device through a gap between fixing and the sheet discharging rollers 118 and/or through a gap of the casing 100. In addition, the dust particles in the space 202 diffuse in the space 202 by the Brownian movement, and finally are carried by either of the air flows 200 and 201. As described above, the rise air flow is a particular factor diffusing the dust particles to the outside of the fixing device.

In view of this, as shown in FIG. 17(*b*), it is desirable that the dust blocking rib 110*b* extends at least to the space 202, and if possible to the region where the rotation air flow is produced toward the pressing roller 102. By this, the rise air flow 201 is blocked so that the dust particles carried by the rise air flow 201 can be closely closed confined in the fixing device. The distance between the blocking rib 110*b* and the pressing roller 102 can be determined easily through heat air flow simulation or the like.

The dust particles produced at the point A diffuse from the neighborhood of the feeding guide 140 as well as through the above-described path. As shown in FIG. 16A, the dust particles produced at the nip 101*b* are blocked by the sheet P, and do not transfer onto the non-printing side during the sheet fixing operation, but after the fixing operation, the dust particles move from the space between the succeeding sheets to the non-printing side. Thus, moved dust particles move to the duplex print feeding portion 15*b* (FIG. 3) and further move through gaps of the duplex print feeding portion 15*b* to the upper portion reverse feeding portion 15, and thus into the machine. The thus scattered dust particles gradually accumulate to the extent of transferring onto the sheet P sooner or later, with the result of producing an adverse effect on the image on the sheet.

Figure 18:
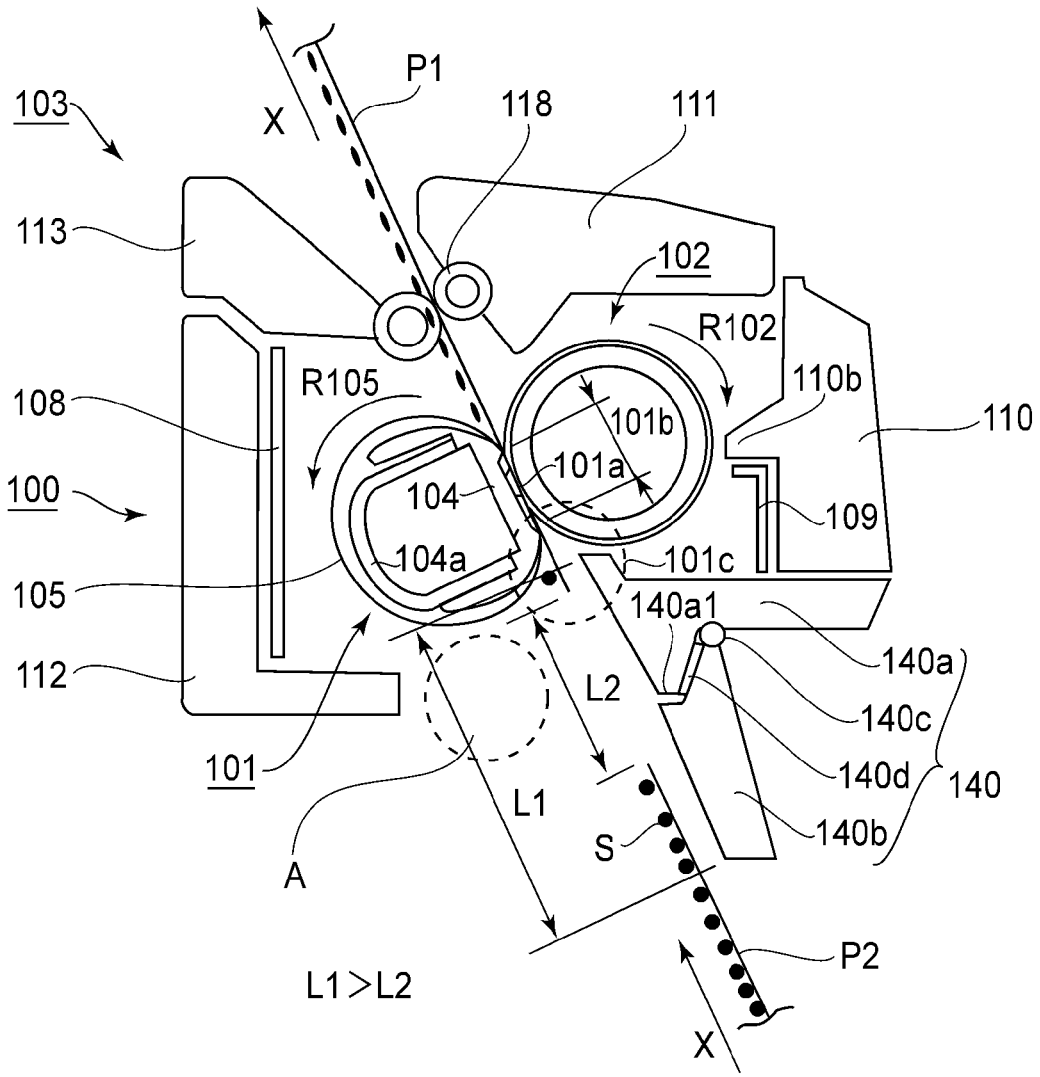
FIG. 18 is a schematic view illustrating a relation between a sheet interval (between adjacent sheets in the continuous sheet processing) and a length of a feeding guide measured in a recording material feeding direction.

FIG. 18 is a schematic view of the fixing device 103 when a prior sheet P1 and the next sheet P2, with the sheet interval L2 therebetween, are at the point A during continuous sheet processing. In order to suppress the above-described dust scattering, in this embodiment, as shown in FIG. 18, the length L1 of the feeding guide 140 of the fixing device 103 extends beyond the sheet interval L2 in the recording material feeding direction X. In order to block the dust particles, the feeding guide 140 does not have an opening in the longitudinal direction within the width of the passing range of the toner image in the nip 101*b*, in the range of the length not less than sheet interval L2 at least in the region of the length L1.

That is, the feeding guide 140 is longer in the recording material feeding direction X than the sheet interval between the prior sheet P1 and the next sheet P2 during the continuous feeding of the sheets P. In addition, no opening is provided at least within the maximum printing area width W2 (FIG. 7) of the sheet P for introducing into the nip 101*b* at a position of the length not more than the sheet interval L2.

For this reason, the second neighborhood (guide frame) 140*a* of the feeding guide 140 and the upstream portion 140*b* of the feeding guide do not have an opening in the longitudinal direction at least within the width of the passing range of the toner image in the nip 101*b*.

The feeding guide 140 of the fixing device 103 of this embodiment comprises the second neighborhood (guide frame) 140*a* and the upstream portion 140*b* of the feeding guide, which are connected with each other by a hinge shaft 140*c*. The second neighborhood is mounted to and supported by the casing 100. The feeding guide upstream portion 140*b* is rotatable about the hinge shaft 140*c* relative to the second neighborhood 140*a*.

The upstream portion 140*b* of the feeding guide in a free state rotates in the direction of sagging from the second neighborhood 140*a* about the hinge shaft 140*c* by the weight thereof. The upstream portion 140*b* of the feeding guide is held in the closed attitude and state shown in FIG. 16A or FIG. 18, in which the top end portion 140*b*1 rotates to abut to and connect with the bottom end portion 140*a*1 of the second neighborhood 140*a*.

In the closed state of the upstream portion 140*b* of the feeding guide, the feeding guide surfaces of the second neighborhood 140*a* and the feeding guide upstream portion 140*b* provide a continuous feeding guide in the up and down direction. Thus, the feeding guide 140 guides, toward the nip 101*b*, the sheet P fed upwardly from the secondary transfer portion, at side of the sheet P opposite from the toner image carrying side.

Here, the bottom end portion 140*a*1 of the second neighborhood 140*a* is provided with a sealing member 130*d*. The sealing member 130*d* seals a gap in the longitudinal direction between the top end portion 140*b*1 of the feeding guide upstream portion 140*b* and the bottom end portion 140*a*1 of the second neighborhood 140*a* when the feeding guide upstream portion 140*b* is in the closing attitude relative to the second neighborhood 140*a*.

By this, the feeding guide 140 as a whole has no opening existing in the longitudinal direction at least within the width of the passing range of the toner image in the nip 101*b*. The sealing member 130*d* may be provided at the top end portion 140*b*1 of the second neighborhood 140*a*, or at each of the bottom end portion 140*a*1 of the second neighborhood 140*a* and the bottom end portion 140*b*1 of the second neighborhood 140*b*.

By the feeding guide 140 free of opening, the dust particles passed through the gap between adjacent sheets do not directly move to the duplex print feeding portion 15*b* (FIG. 3).

According to the fixing device 103 of this embodiment, by the first neighborhood 110*b* extending to the neighborhood of the pressing roller 102, the dust particles produced at the nip 101*b* and flowing between the pressing roller 102 and casing 100 are confined in the casing. The confined dust particles coalesce with each other to become large particles, which are deposited on the casing 100 and the rotating pressing roller 102. The dust particles deposited on the pressing roller 102 are transferred to the sheet P, but they are so small that the image is not influenced thereby.

In addition, the feeding guide 140 adjacent the pressing roller 102 extends beyond the sheet interval L2, by which the phenomenon that the dust particles produced at the nip 101*b* diffuse through the using sheet interval L2 to contaminate the duplex print feeding portion 15*b* and/or the downstream feeding guide portion of the fixing device can be suppressed.

Figure 19:
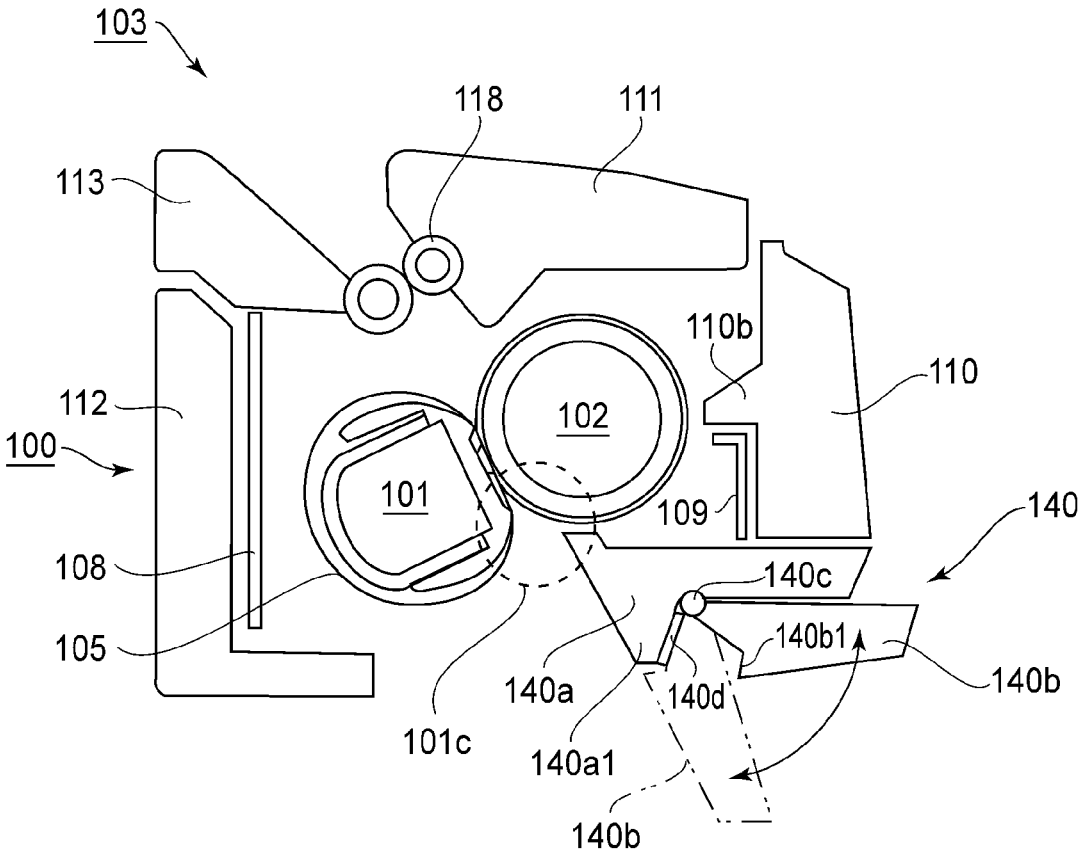
FIG. 19 is a schematic view of a state in which an upstream portion of the feeding guide is raised to an open position.

Upon performing a jammed sheet clearance operation, the right-hand door 130 (FIG. 3) is opened to open the sheet feeding path D (FIG. 5). Then, as shown in FIG. 19, the feeding guide upstream portion 140*b* of the feeding guide 140 is rotated about the hinge shaft 140*c* toward the right-hand door 130 side up to a substantially horizontal position (open attitude). By this, the portion of the nip inlet 101*c* of the fixing device 103 is opened, and the visibility of the sheet inside the fixing device 103 is as good as with the conventional structure.

The rotatability of the upstream portion 140*b* of the feeding guide provides the following advantageous effects. The deterioration of the sheet visibility, by extending the feeding guide 140 toward image forming station (transfer unit 10), when the sheet feeding path D is opened by opening the right-hand door 130 upon jam clearance can be suppressed. In other words, the deterioration of the operationality of the apparatus upon the performance of the jam clearance operation, by extending the pressing roller 102 side feeding guide by the rotatable feeding guide upstream portion 140*b*, can be suppressed.

In addition, with the structure of this embodiment, the high density dust particles stagnate around the feeding guide 140, and therefore, the feeding guide 140 tends to be contaminated. Therefore, the feeding guide upstream portion 140*b* of the feeding guide 140 is detachable from the hinge shaft 140*c* to facilitate the exchanging operation.

When the feeding guide upstream portion 140*b* is contaminated, the feeding guide upstream portion 140*b* is removed from the second neighborhood 140*a* and is cleaned or is replaced with a fresh feeding guide upstream portion 140*b*, thus suppressing the adverse effect of the accumulated dust particles on the image quality. Thus, by the detachably mountable structure of the feeding guiding member, the replacement of the guide contaminated by the wax is easy.

The feeding guide 140 may have such a structure that the entirety thereof or at least a part of the upstream (of the second neighborhood 140*a*) side feeding guiding portion 140*b* with respect to the recording material feeding direction X is rotatable relative to the casing 100. In addition, the feeding guide 140 may have such a structure that the entirety thereof or at least a part of the upstream (of the second neighborhood 140*a*) side feeding guiding portion 140*b* with respect to the recording material feeding direction X is mountable and dismountable relative to the casing 100.

<Others>

1) in Embodiments 1-5, the image forming apparatus 1 has been described as being a full-color laser beam printer comprising a plurality of drums 6, but the image forming apparatus may be a monochromatic copying machine or printer comprising one drum 6. Therefore, the image forming apparatus is not limited to the full-color laser beam printer.

2) the sleeve 105 which is a rotatable member in the fixing device 103 may be a flexible and circulatable endless belt stretched around a plurality of stretching members. The sleeve 105 which is a rotatable member may be a rotatable rigid roller member (heat roller). The sleeve 105 which is a rotatable member may be a non-endless web-like member traveling from an unwinding portion in a winding-up portion.

3) the heating means for the fixing device is not limited to the planar heater 101*a* of the foregoing embodiments. It may be an inside heating type or outside heating type heater such as an electromagnetic induction heater, a halogen heater, an infrared radiation lamp.

4) in the fixing devices of Embodiments 1-5, the pressing roller 102 which is a rotatable member may be an endless belt member. The pressing roller 102 may be a non-rotatable member. For example, it may be a non-rotatable member or the like a pressing pad having a low surface friction coefficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 281250/2012 filed Dec. 25, 2012 which is hereby incorporated by reference.

What is claimed is:

1. An image forming apparatus comprising:

an image forming device configured to form, in a first position, a toner image on a sheet using toner containing a parting material;

a fixing device including first and second rotatable members configured to form a nip portion therebetween for fixing the toner image formed on the sheet by said image forming device in a second position, by heat and pressure;

a fan configured to flow air along an air flow path between said image forming device and said fixing device; and a partition configured and positioned to substantially separate the air flow path and a sheet feeding path from the first position to the second position, wherein one end of said partition directly contacts said first rotatable member.

2. An apparatus according to claim 1, further comprising a guide portion configured and positioned to guide the sheet from the first position toward the second position, wherein said partition is configured to cooperate with said guide portion to confine said sheet feeding path in a substantially closed space.

3. An apparatus according to claim 1, wherein the air flow path extends in a direction substantially perpendicular to said sheet feeding path.

4. An apparatus according to claim 1, wherein said partition includes a flexible sheet contacting said first rotatable member.

5. An apparatus according to claim 1, wherein said image forming device includes a photosensitive member, an intermediary transfer member configured to secondary-transfer, onto the sheet, the toner image primary-transferred from said photosensitive member, in the first position, and the other end of said partition is disposed a predetermined distance from said intermediary transfer member with a predetermined gap therebetween.

6. An apparatus according to claim 5, wherein said partition includes a flexible sheet that is disposed with the predetermined gap between said flexible sheet and said intermediary transfer member.

7. An apparatus according to claim 5, wherein said fixing device is disposed at a level higher than said intermediary transfer member.

8. An apparatus according to claim 1, wherein said partition has a width larger than a width of a maximum width sheet usable with said apparatus, as measured in a direction perpendicular to a feeding direction of the sheet in said sheet feeding path.

9. An apparatus according to claim 1, wherein the second position is at a level higher than said first position.

10. An apparatus according to claim 1, wherein said air flow path formed by said fan extends substantially along a longitudinal direction of said fixing device.

* * * * *